US006220220B1

(12) United States Patent
Aketa et al.

(10) Patent No.: US 6,220,220 B1
(45) Date of Patent: Apr. 24, 2001

(54) FUEL SUPPLYING DEVICE FOR ENGINE

(75) Inventors: Masahiro Aketa; Yasuo Fujii; Hajime Yama; Toshio Nakahira; Yasushi Matsuda, all of Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 09/487,335

(22) Filed: Jan. 19, 2000

(30) Foreign Application Priority Data

Jan. 19, 1999 (JP) ..... 11-010441
Aug. 3, 1999 (JP) ..... 11-219514

(51) Int. Cl.[7] ..... F02D 31/00
(52) U.S. Cl. ..... 123/357
(58) Field of Search ..... 123/372, 373, 123/357, 367

(56) References Cited

U.S. PATENT DOCUMENTS 4,502,437 * 3/1985 Voss ..... 123/357
5,353,762 * 10/1994 Dykstra et al. ..... 123/352
5,613,474 * 3/1997 Nakamura et al. ..... 123/357

FOREIGN PATENT DOCUMENTS 62-84638 5/1987 (JP) .
9-228856 9/1997 (JP) .

* cited by examiner

*Primary Examiner*—Thomas N. Moulis
(74) *Attorney, Agent, or Firm*—Bacon & Thomas, PLLC

(57) ABSTRACT

A fuel supplying device for an engine comprises an electronic governor (1) and a mechanical governor (2). In this device, the mechanical governor (2) limits a maximum fuel injection amount of an electronic control by the electronic governor (1).

22 Claims, 17 Drawing Sheets

FUEL SUPPLYING DEVICE FOR ENGINE

BACKGROUND OF THE INVENTION

1. Technical Field of the Invention

The present invention relates to a fuel supplying device for an engine.

2. Description of Earlier Technology

There is known a conventional technique as the fuel supplying device for an engine, which is provided with an electronic governor and a mechanical governor and conducts an electronic control by the electronic governor and a mechanical control by the mechanical governor. The conventional technique is used by switching it over to an electro-solo control mode or to a mecha-solo control mode.

The conventional technique makes a control of speed and a limitation of a maximum fuel injection amount by the electronic control alone in the electro-solo control mode and does them by the mechanical control alone in the mecha-solo control mode.

The above-mentioned conventional technique has the following problems.

The electro-solo control mode has to limit the maximum fuel injection amount of the electronic control by the electronic governor. Therefore, it is necessary to employ an electronic governor having such a limitation function, which results in increasing the cost of the electronic governor. Further, the electronic governor must be adjusted so that it can make such limitation and therefore such an adjustment takes much labor.

SUMMARY OF THE INVENTION

The present invention has an object to provide a fuel supplying device for an engine, which can solve the foregoing problems.

An invention as defined in claim 1 is constructed as follows.

A fuel supplying device for an engine is provided with an electronic governor 1 and a mechanical governor 2. The mechanical governor 2 is arranged to limit a maximum fuel injection amount of an electronic control by the electronic governor 1.

An invention of claim 2 is constructed as follows.

A maximum fuel injection position 4 of a fuel metering portion 3 in the electronic control comes to a halfway position of a speed control area 5 of the fuel metering portion 3. This fuel supplying device automatically switches over the electronic control by the electronic governor 1 to a mechanical control by the mechanical governor 2 and vice versa at the maximum fuel injection position 4. It performs the electronic control in a fuel decrease side area 5*a* of the speed control area 5 with respect to the maximum fuel injection position 4 and does the mechanical control in a fuel increase side area 5*b* with respect to the maximum fuel injection position 4.

In the present invention, the electronic control means a speed control conducted based on an electronic speed control line 60 designating an electronic control property. A mechanical control means a speed control conducted based on a mechanical speed control line 51 indicating a mechanical control property. The speed control area 5 means an area of a metering area of the fuel metering portion 3, in which fuel metering is effected based on at least one of the electronic speed control line 60 and the mechanical speed control line 51. In the case where the maximum fuel injection position 4 of the fuel metering portion 3 of the electronic control comes to a halfway of the speed control area 5, the maximum fuel injection position 4, as a matter of course, is a position where the electronic control switches over to the mechanical control and vice versa.

The invention of claim 1 produces the following function and effect.

The mechanical governor 2 limits the maximum fuel injection amount of the electronic control. This can remove the limitation function from the electronic governor 1 and eventually reduce the cost of the electronic governor 1. Besides, it is possible to omit or simplify the adjustment of the electronic governor that considers such limitation function and to thereby reduce the labor for its adjustment.

The mechanical governor 2 limits the maximum fuel injection amount of the electronic control. Therefore, in the event that the electronic governor 1 is added to an existing engine with a mechanical governor, which is satisfactory in exhaust gas property, the engine can succeed the satisfactory metering property of the mechanical governor as it is as regards the maximum fuel injection amount of the electronic control. Accordingly, even if the electronic governor 1 is added later to an engine with a mechanical governor, which has cleared the exhaust gas restriction, the engine does not change its exhaust gas property.

Inventions as set forth in claim 2 and subsequent claims produce the following effects and functions in addition to those of the invention as defined in claim 1.

According to the invention of claim 2, in a low load area the electronic control decreases an engine rotation speed to reduce the noise of engine and in a high load area the mechanical control can operate the engine with the same feeling as in the case of operating an existing engine with only the mechanical governor.

The invention of claim 3 can select either a composite control mode or an electro-solo control mode whichever is properly adapted to the operation condition and the operation feeling.

The invention of claim 4 can select either the composite control mode or a mecha-solo control mode whichever is properly adapted to the operation condition and the operation feeling. When switching it over to the mecha-solo control mode, it is possible to operate the engine with the same feeling as in the case of operating an existing engine with only the mechanical governor. Further, even if the electronic governor 1 is in disorder, the mechanical governor 2 can operate the engine without causing any problem.

According to the invention of claim 5, the mechanical governor does not function as a disturbance element in the area 5*a* where the electronic control is performed and the electronic governor 1 does not function as a disturbance element, either in the area 5*b* where the mechanical control is conducted. This produces the following advantage.

It is possible to perform the electronic control and the mechanical control precisely and besides employ low output ones for the electronic governor 1 and the mechanical governor 2, respectively.

The invention of claim 6 performs the fuel metering by the electronic governor 1 in an engine starting area 7 and therefore can make a delicate control in correspondence to the starting condition.

According to the invention of claim 7, when the engine starts at a warm time or restarts while it is still warm just after it has stopped, in correspondence to these starting conditions, fuel supply is reduced to result in the possibility of inhibiting the fuel consumption and the discharge of unburnt poisonous gas.

According to the invention of claim 8, the electronic governor 1 can also serve as an engine stopping device. This dispenses with a circuit and an actuator dedicated for the engine stopping device, which can reduce the cost of engine and make it compact.

According to the invention of claim 9, when operation failure of the electronic governor 1 has cancelled energizing an actuator 17, an urging force of a spring 33 forces an electronic output portion 9 to move the fuel metering portion 3 up to a fuel supply stop position 8 and stays it there. Thus restarting the engine is tried in vain, which can confirm the operation failure of the electronic governor 1.

According to the invention of claim 10, while the engine is in operation, at loads (L4) to (L1) below a reference load (L5) the electronic governor 1 settles an engine rotation speed lower than the mechanical governor 2 does. This can decrease the noise of engine at partial loads (L4) to (L2) and no load (L1).

Further, the invention of claim 10 can set a steady state rotation speed (NX) of the electronic control at loads (L4) to (L1) below the reference load (L5) to a value identical or close to that of a steady state rotation speed (NX) of the electronic control at the reference load (L5). Accordingly, it is possible to keep the working efficiency at the rated load (L5) high while inhibiting the noise of engine at the partial loads (L4) to (L2) and the no load (L1).

The inventions of claim 11 and subsequent claims produce the following effects and functions in addition to those of the invention as defined in claim 10.

The invention of claim 11 can be usefully employed for an engine generator or the like usage that requires to maintain the engine rotation speed constant.

The invention of claim 12 can change a composite control property obtained by combining an electronic control property with a mechanical control property, through a single operation with ease.

The invention of claim 13 can set composite control properties different in reference load and select a proper one in accordance with the usage of engine.

The invention of claim 14 can freely set composite control properties different in reference load and adapt them to a wide range of use of engine.

The invention of claim 15 limits an engine rotation speed (N) to not higher than a rated rotation speed (NT) and therefore can reduce the noise of engine.

The invention of claim 16 can increase the engine rotation speed (N) to a working start speed (ST) soon by the mechanical governor 2 even if the electronic governor 1 slow in steady state speed is employed.

The invention of claim 17 produces the following advantage.

In the case where the steady state speed of the electronic governor 1 is slow, the electronic control is unlikely to increase fuel promptly even if the engine rotation speed (N) is reduced due to the increase of load. However, in the event the engine rotation speed (N) goes down to less than a lower limit value (ZL) of a controlled speed zone (Z), the mechanical governor 2 increases the fuel promptly. Therefore, the engine stop hardly occurs even if the electronic governor 1 slow in steady state speed is utilized.

According to the invention of claim 18, if excessive rotation increase occurs, urgent fuel decrease working moves the fuel metering portion 3 to a fuel decrease side immediately, thereby being able to decrease fuel supply. Thus it is possible to quickly solve the excessive rotation increase.

The invention of claim 19 produces the following advantage.

A position detecting means costs so high that nonuse of this means can reduce the cost of the electronic governor 1.

Further, according to the invention of claim 19, in the case where the utilized electronic governor 1 does not include a metering position detecting means of the fuel metering portion 3, it is impossible to take a metering position of the fuel metering portion 3 for a control target. Consequently, when compared with an electronic governor that includes the metering position detecting means, the steady state speed of the electronic governor 1 is reduced. However, if the inventions of claim 16 and 17 are added, the engine can improve the disadvantage caused by the reduced steady state speed since it can promptly increase the engine rotation speed (N) and inhibit the engine stop as mentioned above.

According to the invention of claim 20, the electronic governor 1 conducts a control working through PID or PI control and does its arithmetic processing without totalizing the data obtained before it starts working. Thus it is possible to prohibit the delay of the electronic control caused through the data accumulation.

According to the invention of claim 21, in the case where a speed setting means 18 carries out a quick acceleration, even if the electronic governor 1 excessively responds to the quick acceleration, thereby advancing the output portion 9 of the electronic governor 1 too much in a direction for fuel increase and causing the fuel metering portion 3 to try to overshoot in the direction for fuel increase, the output portion 10 of the mechanical governor 2 can receive the fuel metering portion 3. This results in the possibility of inhibiting the fuel increase caused by the excessive response of the electronic governor 1.

The invention of claim 22 can approach an engine torque to a maximum one even in a low rotation area. This can enhance the function of inhibiting the engine stop.

DESCRIPTION OF THE PREFERRED EMBODIMENTS

Embodiments of the present invention are explained with reference to the drawings. FIGS. 1 to 12 explain a fuel supplying device for a diesel engine according to a first embodiment of the present invention.

The fuel supplying device will be outlined as follows.

Figure 2:
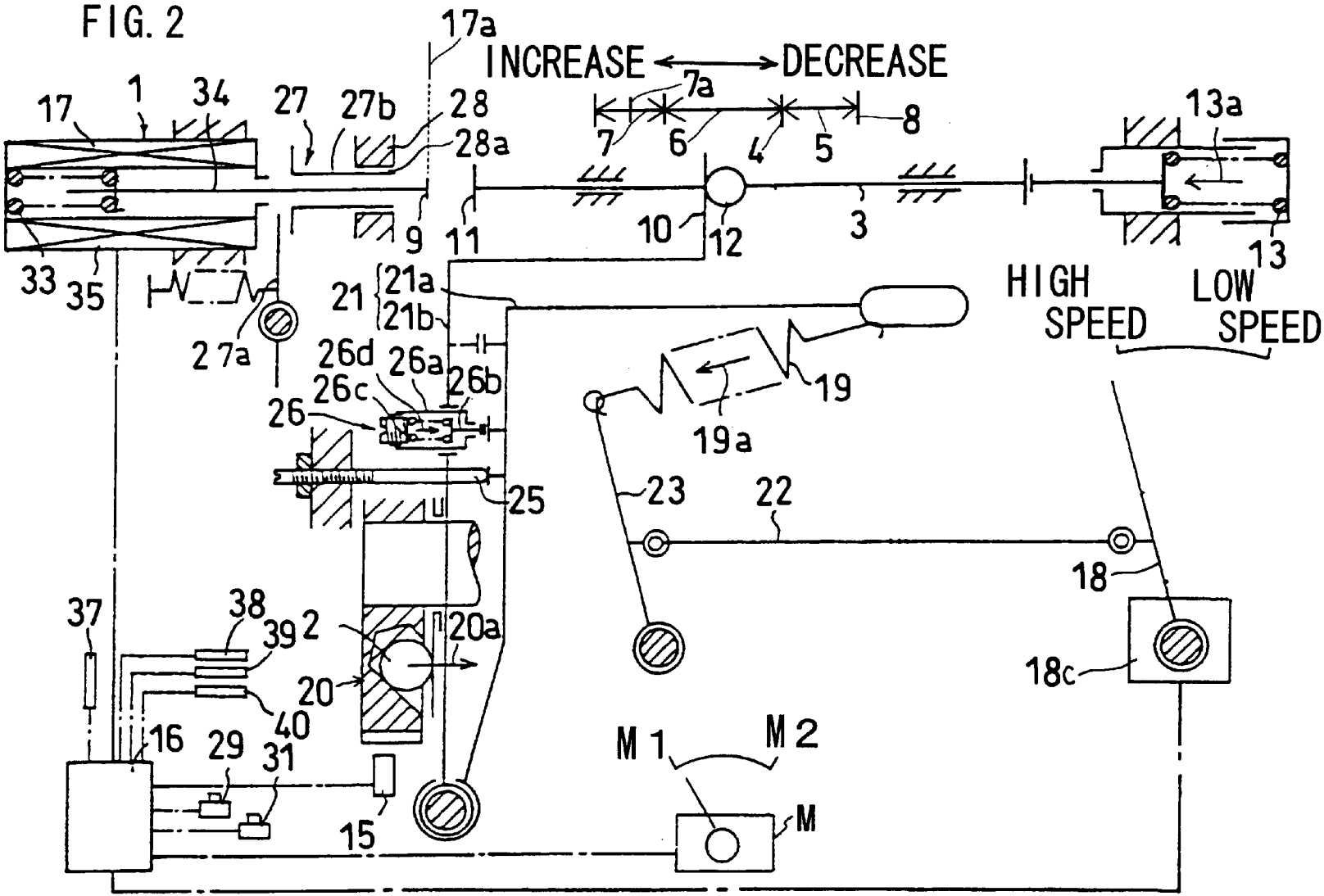
FIG. 2 schematically shows an electronic governor and a mechanical governor of the first embodiment.

As shown in FIG. 2, this fuel supplying device comprises an electronic governor 1 and a mechanical governor 2. It conducts an electronic control by the electronic governor 1 and does a mechanical control by the mechanical governor 2. And the mechanical governor 2 limits a maximum fuel injection amount of the electronic control by the electronic governor 1. The electronic governor 1 includes an electronic output portion 9 and the mechanical governor 2 includes a mechanical output portion 10, respectively. The fuel metering portion 3 comprises an electronic input portion 11 and a mechanical input portion 12.

The electronic output portion 9 faces the electronic input portion 11 from a fuel increase side and the mechanical output portion 10 opposes the mechanical input portion 12 from the fuel increase side. An urging means 13 urges the fuel metering portion 3 toward the fuel increase side. In an area 5*a* where the electronic control is performed, the electronic input portion 11 is brought into contact with the electronic output portion 9, thereby connecting the former to the latter and retaining the mechanical input portion 12 separated from the mechanical output portion 10. In an area 5*b* where the mechanical control is performed, the mechanical input portion 12 is brought into contact with the mechanical output portion 10, thereby connecting the former to the latter and retaining the electronic input portion 11 separated from the electronic output portion 9.

The fuel metering portion 3 is a fuel metering rack of a fuel injection pump. The electronic input portion 11 is an end surface on the fuel increase side of the fuel metering rack, and the mechanical input portion 12 is a rack pin. The fuel metering portion 3 is urged in a direction for fuel increase with a force 13*a* of the urging spring 13.

The mechanical governor 2 is constructed as follows.

As shown in FIG. 2, the mechanical governor 2 comprises a governor lever 21, a governor spring 19, a governor weight 20 and a fuel limiter 25. The governor lever 21 comprises a first lever 21*a* and a second lever 21*b*. The first lever 21*a* is interlockingly connected to a speed setting means 18 through the governor spring 19, an interlocking lever 23 and a connecting rod 22. The speed setting means 18 sets a speed to adjust a force 19*a* of the governor spring 19. The second lever 21*b* comprises the output portion 10 and a torque-up device 26. The output portion 10 receives the mechanical input portion 12 of the fuel metering portion 3 urged with the urging spring force 13*a*.

The torque-up device 26 comprises a torque case 26*a*, a torque pin 26*b* and a torque spring 26*c*. The torque case 26*a* is attached to the second lever 21*b* so as to be able to advance and retreat. The torque pin 26*b* is urged with a force 26*d* of the torque spring 26*c* in a direction for pushing it out of the torque case 26*a* and has a leading end which opposes the first lever 21*a*. The governor weight 20 faces the second lever 21*b* and produces a governing force 20*a* in response to an engine rotation speed (N). The fuel limiter 25 is attached to a gear case wall so as to be able to advance and retreat and has a leading end which opposes the second lever 21*b*. The fuel limiter 25 can adjust an output at a rated load by advancing and retreating and the torque case 26*a* can also adjust an upper limit of the fuel increase at an over-rated load by advancing and retreating.

The mechanical governor 2 works as follows.

Figure 3:
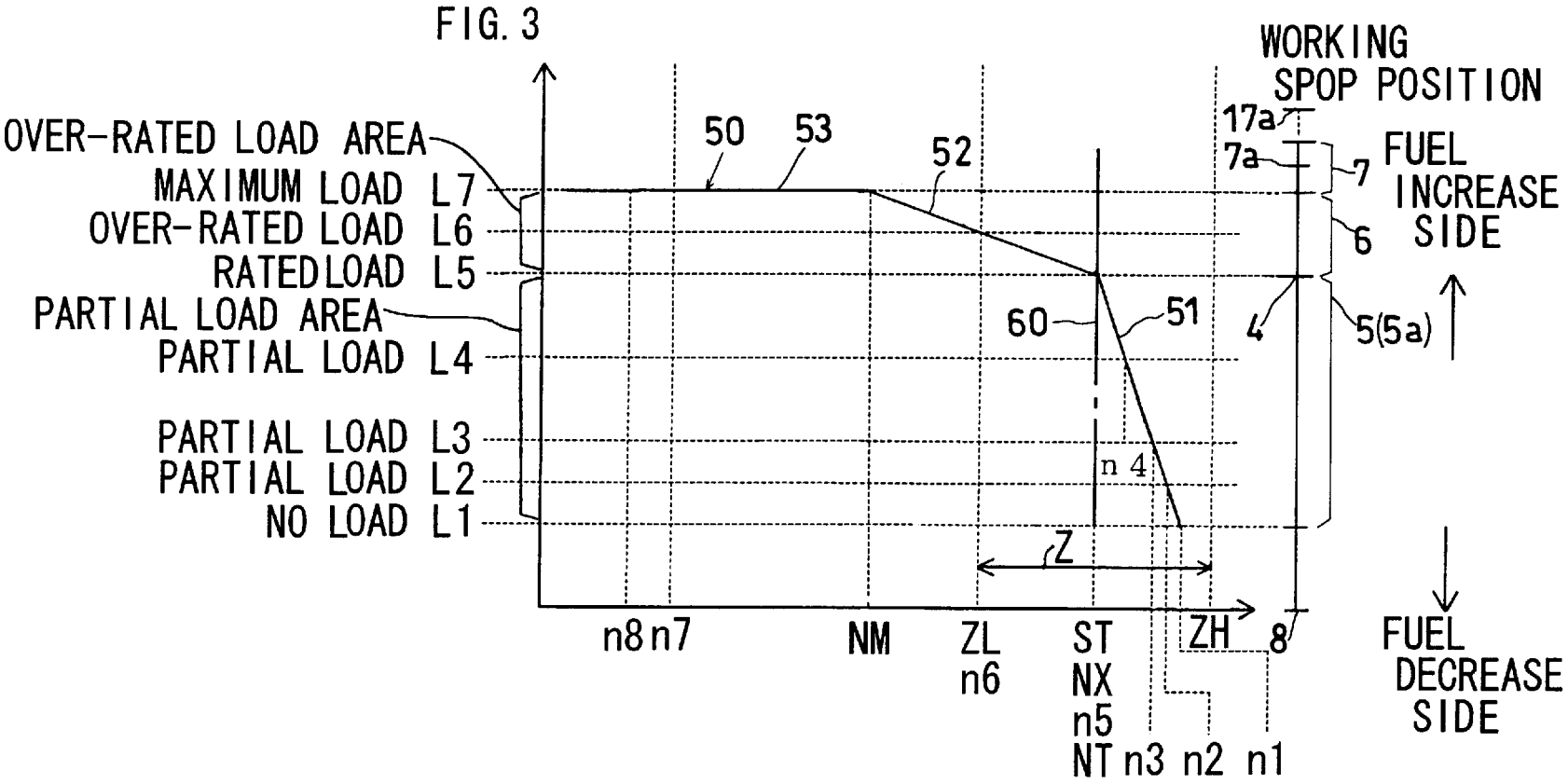
FIG. 3 graphically shows control properties of the first embodiment set at a high speed and in a mode (M1)

While the engine is in operation, the first lever 21*a* and the second lever 21*b* integrally swing due to unbalance between the governor spring force 19*a* and the governing force 20*a* and the urging spring force 13*a* until the first lever 21*a* is received by the leading end of the fuel limiter 25. As the load increases, the engine rotation speed decreases. When the first lever 21*a* is received by the leading end of the fuel limiter 25, only the second lever 21*b* swings due to unbalance between the torque spring force 26*d* and the governing force 20*a* and the urging spring force 13*a*. When the engine starts, the governing force 20*a* is small until the engine rotation speed (N) reaches a rotation speed (n8) at the end of starting fuel increase shown in FIG. 3. Therefore, the urging spring force 13*a* holds the fuel metering portion 3 in a starting fuel increase area 7 to make the starting fuel increase possible. In this case, the second lever 21*b* is pushed by the fuel metering portion 3 to largely incline so as not to interfere with the starting fuel increase. In FIG. 3, numeral (n7) indicates an idling rotation speed to ascertain the start.

The electronic governor 1 is constructed as follows.

As shown in FIG. 2, the electronic governor 1 comprises a controller 16, an actuator 17, a set speed detecting means 18*c*, a rotation speed detecting means 15 and a reference load changing means (M). The actuator 17 is a linear solenoid, and it comprises an output rod 34, a spring 33 and a magnetic coil 35. The output rod 34 has at its leading end the output portion 9, which receives the electronic input portion 11 of the fuel metering portion 3. The spring 33 urges the output rod 34 in a direction for pushing it out. The magnetic coil 35 pulls the output rod 34 in a direction for withdrawing it.

The set speed detecting means 18*c* is a potentiometer which detects a speed setting position of the speed setting means 18 and send to the controller 16 a speed setting voltage corresponding to the speed setting position as a speed setting signal. The speed setting means 18 is of single type that serves to set the speeds of both the electronic governor 1 and the mechanical governor 2. The speed setting of the speed setting means 18 of this single type can set an electronic control property and a mechanical control property in series. Further, the set speed detecting means 18*c* can detect the set speeds of both the electronic governor 1 and the mechanical governor 2. The rotation speed detecting means 15 detects the engine rotation speed (N) and sends a detected speed signal to the controller 16. The reference load changing means (M) comprises a switch-over lever which selects the alternative of a mode (M1) and a mode (M2) to change a reference load to be mentioned later. Although the electronic governor 1 does not include a metering position detecting means that directly detects a metering position of the fuel metering portion 3, it may be provided with such means.

The controller 16 conducts the following processing.

It sets an electronic control property based on the detected set speed signal sent from the set speed detecting means 18*c* and the mode set by the reference load changing means (M). Then it calculates a deviation between the engine rotation speed (N) and a steady state rotation speed (NX) of the electronic control determined on the base of the set electronic control property and sets a duty ratio of PWM wave based on the calculated deviation value. Thereafter, it sends the PWM wave to a switching element of an energizing circuit which energizes the magnetic coil 35 of the actuator 17 so as to adjust output of the actuator 17 and approaches the engine rotation speed (N) to the steady state rotation speed (NX) of the electronic control.

Explanation is given below regarding the manner and behavior in which the electronic control property and the mechanical control property are set.

If the speed setting means 18 shown in FIG. 2 sets a high speed and the reference load changing means (M) selects the mode (M1), it will provide such a control property as schematically depicted in FIG. 3. This schematic view illustrates the respective steady state rotation speeds and the like of the mechanical control and the electronic control with respective loads imposed. In FIG. 3 a full line schematically shows a mechanical control property line 50. The mechanical control property line 50 has one inclined line which is close to a vertical line and designates a speed control line 51 and the other inclined line which is close to a horizontal line and indicates a torque-up line 52. The horizontal line shows a full load line 53. A one-dot chain line shows an electronic speed control line 60. From rated load (L5) to no load (L1), the mechanical control property comes to a droop control property in which as the load decreases, the respective steady state rotation speeds (n5) to (n1) gradually increase. In an over-rated load area, it comes to a torque-up property in which as the load increases, a steady state rotation speed (n6) becomes lower than the steady state rotation speed (n5) at the rated load (L5). The electronic control property comes to an isochronous control property in which the respective steady state rotation speeds (NXs) take the same value from over-rated load (L6) to no load (L1). Please note the electronic speed control line 60 may be set so that it comes to the droop control property as well as the mechanical speed control line.

The relationship between the electronic control property and the mechanical control property is as follows.

Defined as the reference load is a load at a point where the mechanical control property line 50 crosses the electronic speed control line 60. In the case where the reference load changing means (M) selects the mode (M1), as shown in FIG. 3, the rated load (L5) comes to the reference load. The steady state rotation speed (NX) of the electronic control at the rated load (L5) of the reference load is coincident with the steady state rotation speed (n5) of the mechanical control at the same load (L5). The steady state rotation speed (NX) of the electronic control at the loads (L4) to (L1) below the rated load (L5) is lower than the steady state rotation speeds (n4) to (n1) of the mechanical control at the same loads (L4) to (L1). The torque-up steady sate rotation speed (n6) at the over-rated load (L6) becomes lower than the steady state rotation speed (NX) of the electronic control at the same load (L6).

The engine rotation speed (N) is settled in the following behavior.

While the engine is in operation, at the rated load (L5) of the reference load, the electronic governor 1 and the mechanical governor 2 settle the engine rotation speed (N) on the steady state rotation speed (NX) of the electronic control and the steady state rotation speed (n5) of the mechanical control, respectively. The steady state rotation speed (NX) has the same value as that of the steady state rotation speed (n5). At the loads (L4) to (L1) below the rated load (L5), the electronic governor 1 settles the engine rotation speed (N) on the steady state rotation speed (NX) of the electronic control. At the over-rated load (L6), the mechanical governor 2 reduces the engine rotation speed (N) to the torque-up steady state rotation speed (n6) close to a maximum torque rotation speed (NM).

How to settle the engine rotation speed (N) is as follows.

While the engine is in operation, at the rated load (L5) of the reference load, based on the electronic speed control line 60 and the mechanical speed control line 51, a settling position of the fuel metering portion 3 by the electronic control is coincident with a settling position of the fuel metering portion 3 by the mechanical control, which composes a maximum fuel injection position 4 of the fuel metering portion 3 in the electronic control. In this case, the output portion 9 of the electronic governor 1 receives the electronic input portion 11 of the fuel metering portion 3 and the output portion 10 of the mechanical governor 2 receives the mechanical input portion 12 of the fuel metering portion 3, respectively. Both of the electronic governor 1 and the mechanical governor 2 set the fuel metering portion 3 to the maximum fuel injection position 4 and settle the engine rotation speed (N) on the steady state rotation speed (NX) of the electronic control and the steady state rotation speed (n5) of the mechanical control, respectively.

At the loads (L4) to (L1) below the rated load (L5) of the reference load, the device takes an electro-solo control mode where only the electronic control is performed over the whole area 5*a* of a speed control area 5 based on the electronic speed control line 60. The output portion 9 of the electronic governor 1 receives the electronic input portion 11 of the fuel metering portion 3 and the output portion 10 of the mechanical governor 2 separates from the mechanical input portion 12 of the fuel metering portion 3 toward the fuel increase side. And the electronic governor 1 settles the fuel metering portion 3 in the fuel decrease side area 5*a* with respect to the maximum fuel injection position 4 and settles the engine rotation speed (N) on the steady state rotation speed (NX) of the electronic control.

At the over-rated load (L6) above the reference load (L5), based on the torque-up line 52 the output portion 10 of the mechanical governor 2 receives the mechanical input portion 12 of the fuel metering portion 3 in a torque-up area 6 and the output portion 9 of the electronic governor 1 separates from the electronic input portion 11 of the fuel metering portion 3 toward the fuel increase side. And the mechanical governor 2 settles the fuel metering portion 3 in the torque-up area 6 of the fuel increase side with respect to the maximum fuel injection position 4 and reduces the engine rotation speed (N) to the torque-up steady state rotation speed (n6).

Load fluctuation entails the following transition property.

When the load decreases from the rated load (L5) of the reference load to the loads (L4) to (L1), the output portion 10 of the mechanical governor 2 separates from the mechanical input portion 12 of the fuel metering portion 3 toward the fuel increase side and the electronic control is performed prior to the mechanical control. Conversely, when the load increases from the rated load (L5) to the over-rated load (L6), the output portion 9 of the actuator 17 separates from the electronic input portion 11 of the fuel metering portion 3 toward the fuel increase side, and the mechanical control is performed prior to the electronic control. The working of the mechanical governor 2 is not inputted as a disturbance element at the time of the electronic control and the working of the electronic governor 1 is not inputted as a disturbance element at the torque-up time, either. This improves the electronic control and the torque-up in accuracy. Additionally, the electronic governor 1 can use an actuator 17 small in size and output.

However, in the case where while the electronic control is performed, the output portion 9 of the electronic governor 1 advances too much toward the fuel increase side or the output portion 10 of the mechanical governor 2 does not move to the fuel increase side promptly due to the difference of the steady state speed between the electronic control and the mechanical control or the like, the mechanical input portion 12 of the fuel metering portion 3 may be temporarily received by the output portion 10 of the mechanical governor 2 and the output portion 9 of the electronic governor 1 may separate from the electronic input portion 11 of the fuel metering portion 3. Conversely, in the event while the torque up is performed, the output portion 10 of the mechanical governor 2 advances too much to the fuel increase side or the output portion 9 of the electronic governor 1 does not move to the fuel increase side immediately, the electronic input portion 11 of the fuel metering portion 3 may be received by the output portion 9 of the electronic governor 1 and the output portion 10 of the mechanical governor 2 may temporarily separate from the mechanical input portion 12 of the fuel metering portion 3.

The reference load is changed in the following manner and behavior.

Figure 4:
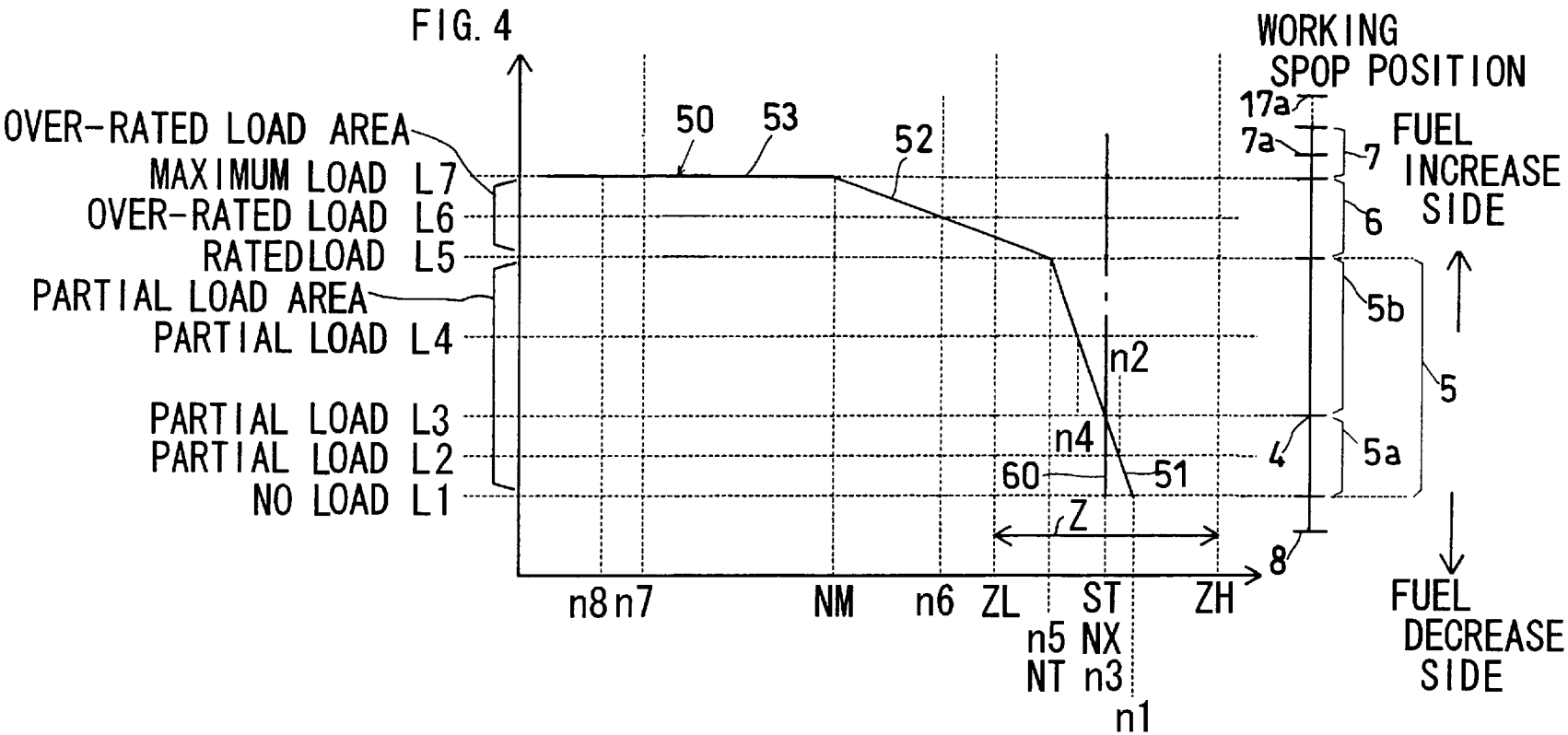
FIG. 4 graphically shows control properties of the first embodiment set at a high speed and in a mode (M2)

When the reference load changing means (M) is switched over to the mode (M2) with the speed setting means 18 shown in FIG. 2 set at a high speed position, as shown in FIG. 4, only the electronic speed control line 60 indicated by a one-dot chain line shifts to a high speed side and the reference load changes from the rated load (L5) to the partial load (L3). In this case, the steady state rotation speed (NX) of the electronic control at the partial load (L3) of a new reference load is coincident with a steady state rotation speed (n3) of the mechanical control at the same load (L3). The steady state rotation speed (NX) of the electronic control at the loads (L2) and (L1) below the partial load (L3) becomes lower than steady state rotation speeds (n2) and (n1) of the mechanical control at the same loads (L2) and (L1), respectively. The steady state rotation speeds (n4) to (n6) of the mechanical control at the loads (L4) to (L6) above the partial load (L3) become lower than the steady state rotation speed (NX) of the electronic control at the same loads (L4) to (L6). As such the maximum fuel injection position 4 of the electronic control can be changed.

The engine rotation speed (N) is settled in the following behavior.

While the engine is in operation, at the partial load (L3) of the reference load, based on the electronic speed control line 60 and the mechanical speed control line 51 both of the electronic governor 1 and the mechanical governor 2 set the fuel metering portion 3 to the maximum fuel injection position 4 and settle the engine rotation speed (N) on the respective steady state rotation speeds (NX) and (n3) of the electronic control and the mechanical control. At the loads (L2) and (L1) below the partial load (L3), based on the electronic speed control line 60 the electronic governor 1 settles the fuel metering portion 3 in the fuel decrease side area 5*a* of the speed control area 5 with respect to the maximum fuel injection position 4 and settles the engine rotation speed (N) on the steady state rotation speed (NX) of the electronic control. From the partial load (L4) to the rated load (L5) above the partial load (L3), based on the mechanical speed control line 51 the mechanical governor 2 settles the fuel metering portion 3 in the fuel increase side area 5*b* with respect to the maximum fuel injection position 4 and settles the engine rotation speed (N) on the steady state rotation speeds (n4) to (n5) of the mechanical control. More specifically, the maximum fuel injection position 4 of the fuel metering portion 3 in the electronic control is adjusted to come to a halfway of the speed control area 5 of the fuel metering portion 3. This device takes the composite control mode in which the electronic control automatically switches over to the mechanical control and vice versa at the maximum fuel injection position 4. At the over-rated load (L6), based on the torque-up line 52 the mechanical governor 2 conducts the torque-up. In this case, from the light load (L2) to the no load (L1), the settling is performed by the electronic control, so that even if the urging spring force 13*a* becomes smaller, hunting more hardly occurs than by the mechanical control. Thus the engine can employ an actuator 17 small in size and output.

The load fluctuation entails the following transition property.

When the load decreases from the partial load (L3) of the reference load to the loads (L2) and (L1), the electronic control operates prior to the mechanical control. Conversely, when the load increases from the partial load (L3) of the reference load to the loads (L4) and (L5), the mechanical control operates prior to the electronic control. However, in the event the load increases from the partial load (L3) of the reference load to the over-rated load (L6), although initially the mechanical control operates prior to the electronic control, the mechanical governor conducts the torque-up prior to the electronic control from a half way. For the same reason as in the case where the reference load is the rated load (L5), while the electronic control is in operation, the mechanical input portion 12 of the fuel metering portion 3 may probably be received by the output portion 10 of the mechanical governor 2. And while the mechanical control is in operation, the electronic input portion 11 of the fuel metering portion 3 may probably be received by the output portion 9 of the electronic governor 1.

The speed setting is changed in the following manner and behavior.

Figure 5:
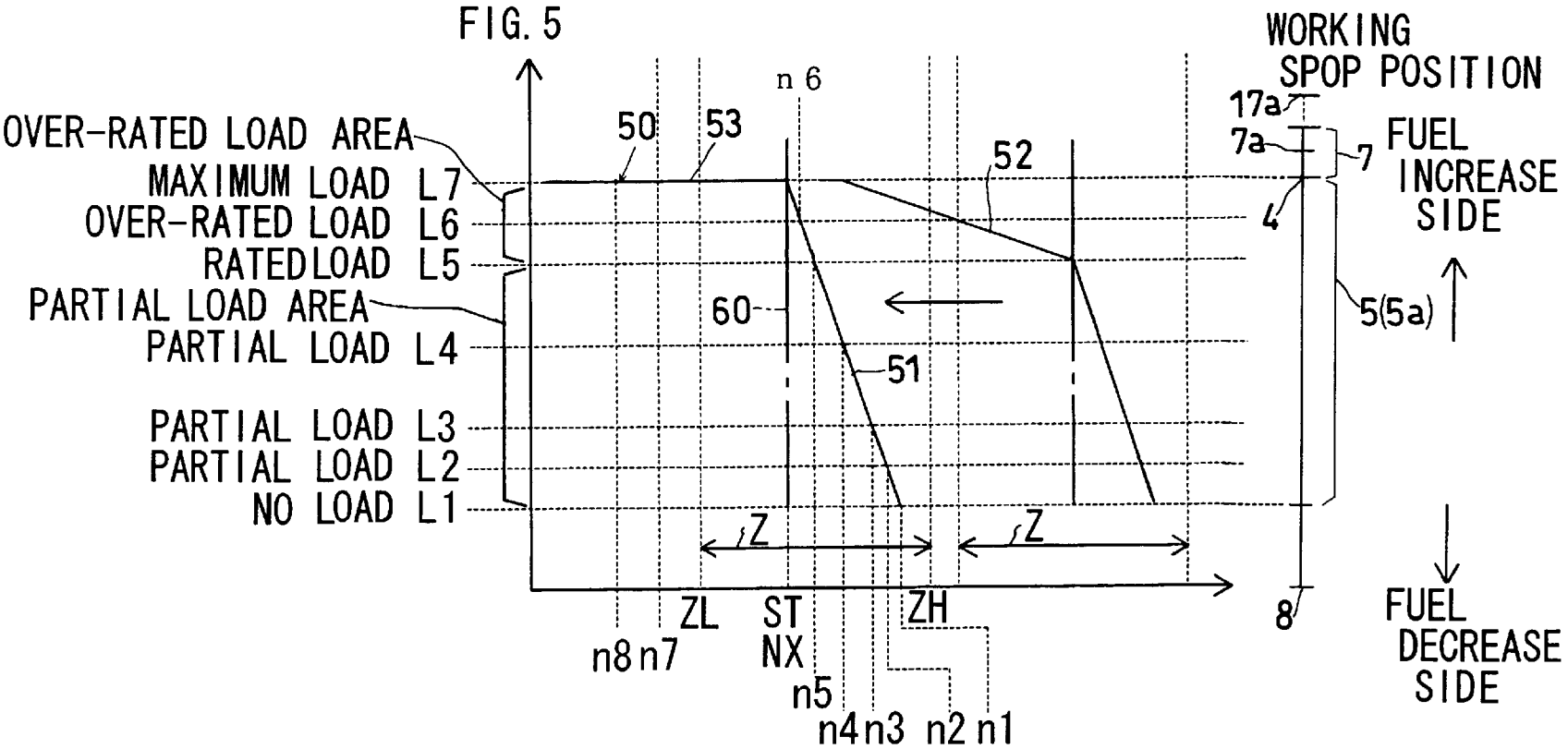
FIG. 5 graphically shows control properties of the first embodiment set at a low speed and in a mode (M1)
Figure 6:
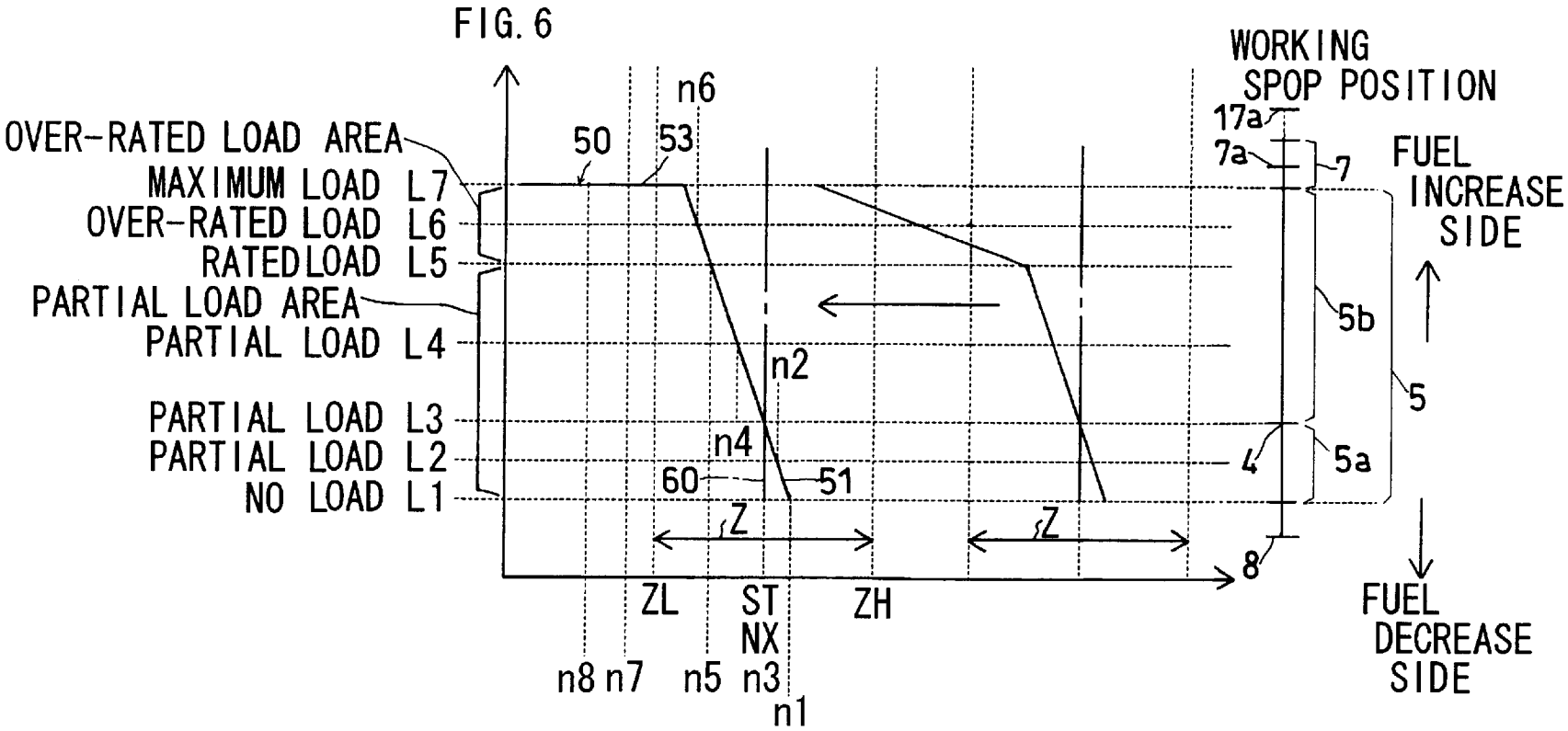
FIG. 6 graphically shows control properties of the first embodiment set at a low speed and in a mode (M2)

When the speed setting means 18 changes the speed setting from a high speed to a low speed with the reference load changing means (M) shown in FIG. 2 set to the mode (M1), as shown in FIG. 5, both the electronic speed control one dot chain line 60 and the mechanical speed control full line 51 make parallel movements toward the low speed side. Besides, when the speed setting means 18 changes speed setting from a high speed to a low speed with the reference load changing means (M) set to the mode (M2), as shown in FIG. 6, both the electronic speed control one dot chain line 60 and the mechanical speed control full line 51 make parallel movements toward the low speed side. It is to be noted if the speed setting means 18 shifts the speed setting from the high speed side to the low speed side, the torque-up property disappears in an over-rated load area.

The engine rotation speed (N) is limited in the following manner and behavior.

Figure 7:
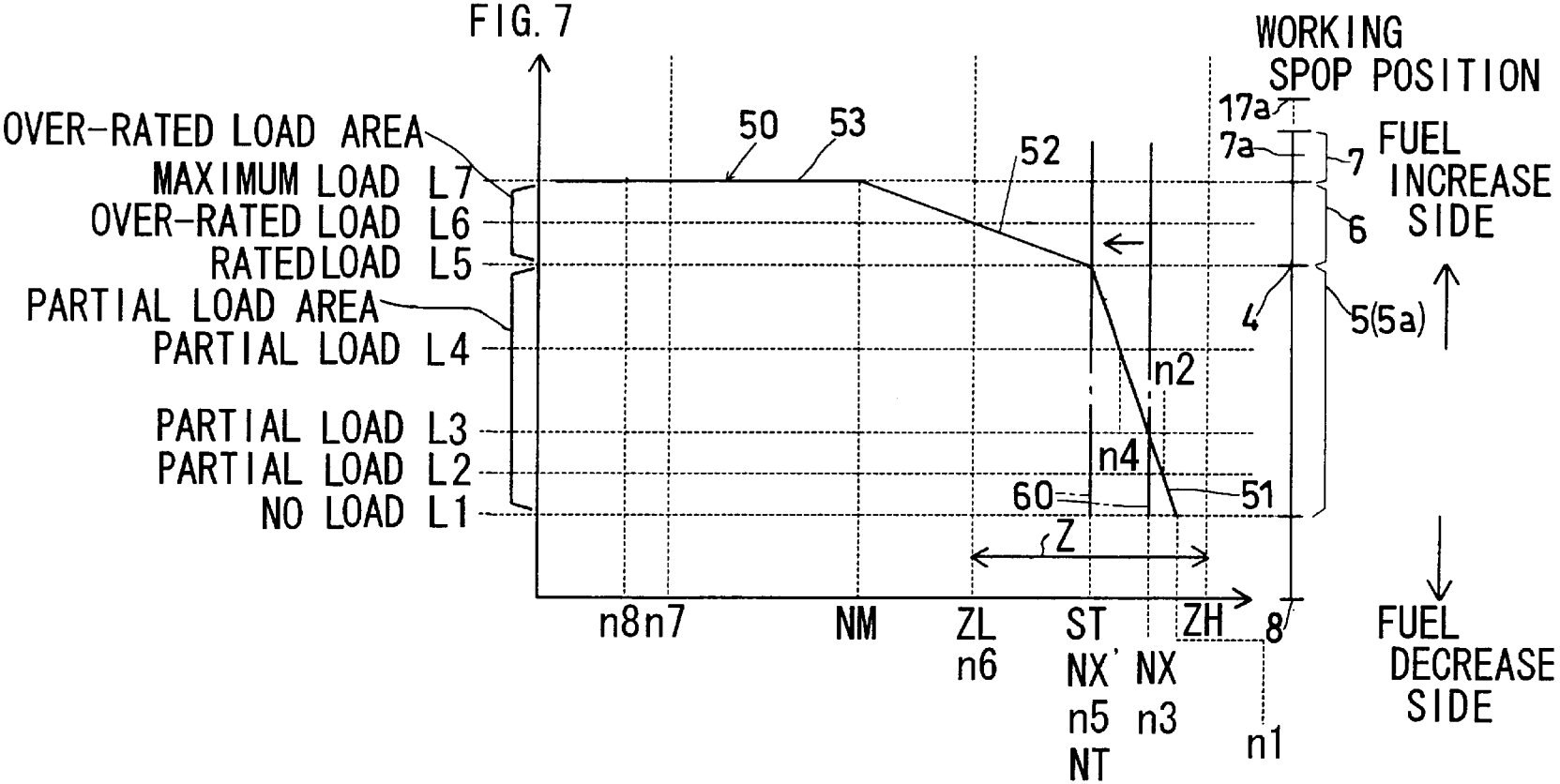
FIG. 7 graphically shows control properties of the first embodiment when limiting speed.

In the event the speed setting means 18 sets a high speed while the reference load changing means (M) shown in FIG. 2 is set to the mode (M2), as shown in FIG. 4, the steady state rotation speed (NX) of the electronic control at the partial load (L3) of the reference load exceeds the engine rated rotation speed (NT). In this case, with a speed limiting switch 29 shown in FIG. 2 put on, as shown in FIG. 7 the controller 16 varies the reference load from the partial load (L3) to the rated load (L5). In this event, while the engine is in operation, from the loads (L5) to (L1) equal to and below the rated load (L5) of a new reference load, the electronic governor 1 settles the engine rotation speed (N) on the same steady state rotation speed (NX') of the electronic control as the rated rotation speed (NT). At the over-rated load (L6) exceeding the rated load (L5) of the new reference load, the mechanical governor 2 reduces the engine rotation speed (N) to the torque-up steady state rotation speed (n6) lower than the rated rotation speed (NT).

The mecha-solo control is set in the following manner and behavior.

Figure 8:
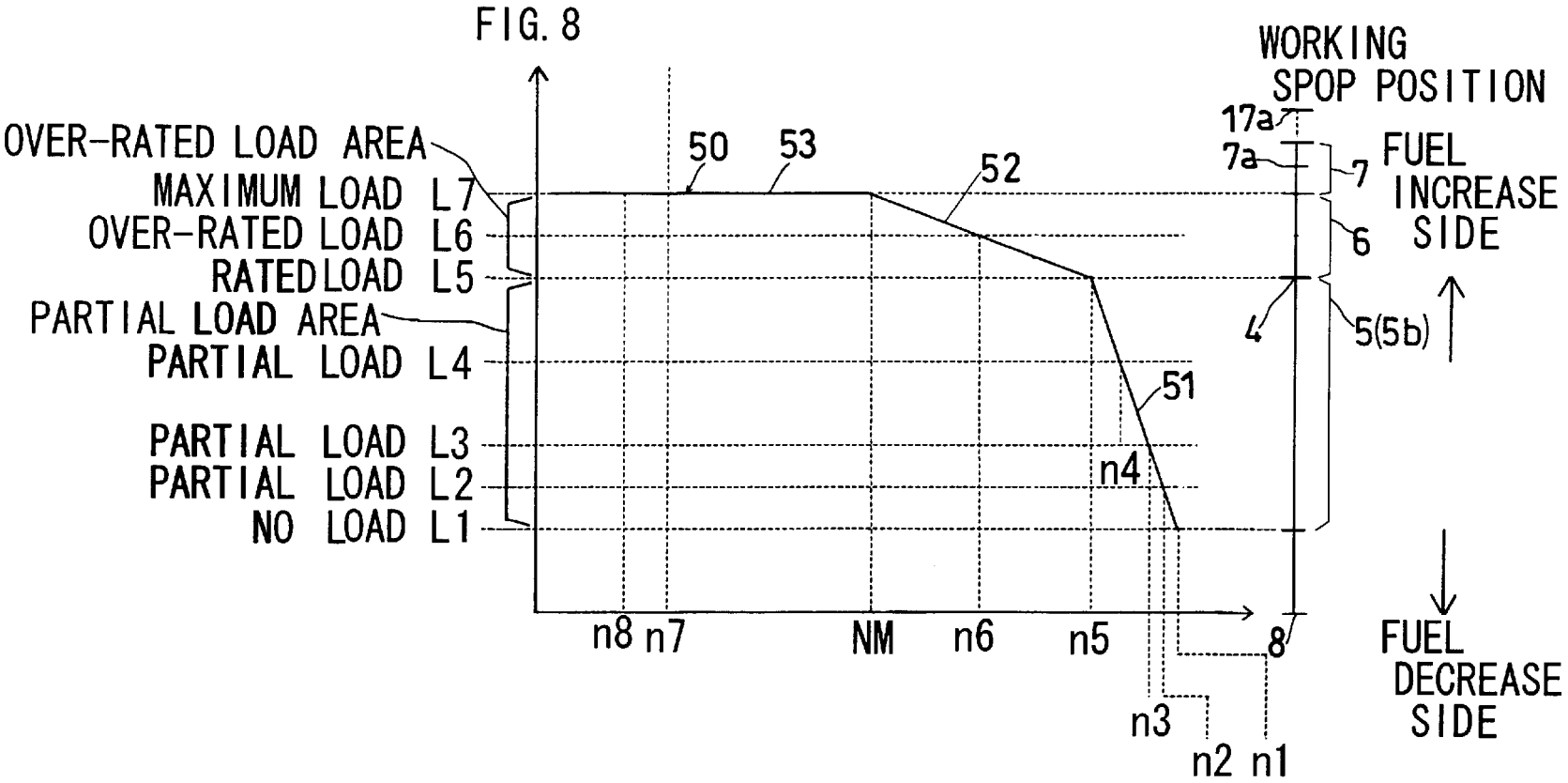
FIG. 8 graphically shows a control property at the time of a mecha-solo control of the first embodiment.

With an electronic working stop switch 31 as shown in FIG. 2 put on, the output portion 9 of the actuator 17 stands still at a working stop position 17*a* removed from a working range of the electronic input portion 11 of the fuel metering portion 3 toward the fuel increase side. In this case, the composite control of the electronic control and the mechanical control or the electro-solo control switches over to the mecha-solo control based on the mechanical speed control line 51 as shown in FIG. 8.

The engine stops by the following construction.

This fuel supplying device is provided with a manual engine stop means 27 as shown in FIG. 2. The engine stop means 27 comprises an stop actuation lever 27*a* and a stop output portion 27*b*. The stop output portion 27*b* is cylindrical and is inserted into a guide bore 28*a* of an engine machine wall 28 so as to be able to advance and retreat. And it has a leading end which faces the electronic input portion 11 of the fuel metering portion 3. When the stop actuation lever 27*a* pushes the stop output portion 27*b* toward the fuel decrease side, its leading end is brought into contact with the electronic input portion 11, thereby pushing the fuel metering portion 3 against the urging spring force 13*a* to a fuel supply stop position 8. Further, the actuator 17 can also push the fuel metering portion 3 to the fuel supply stop position 8. This can dispense with a circuit and an actuator dedicated for an engine stop device. The actuator 17 has the output portion 9 urged by the spring 33. Therefore, when disorder of the electronic governor 1 cancels energizing the actuator 17, the output portion 9 pushes the fuel metering portion 3 through the urging force of the spring 33 to the fuel supply stop position 8 and stays it there. In this case, the engine cannot restart and therefore the disorder of the electronic governor 1 can be confirmed.

The electronic governor 1 has the following function.

Figure 1:
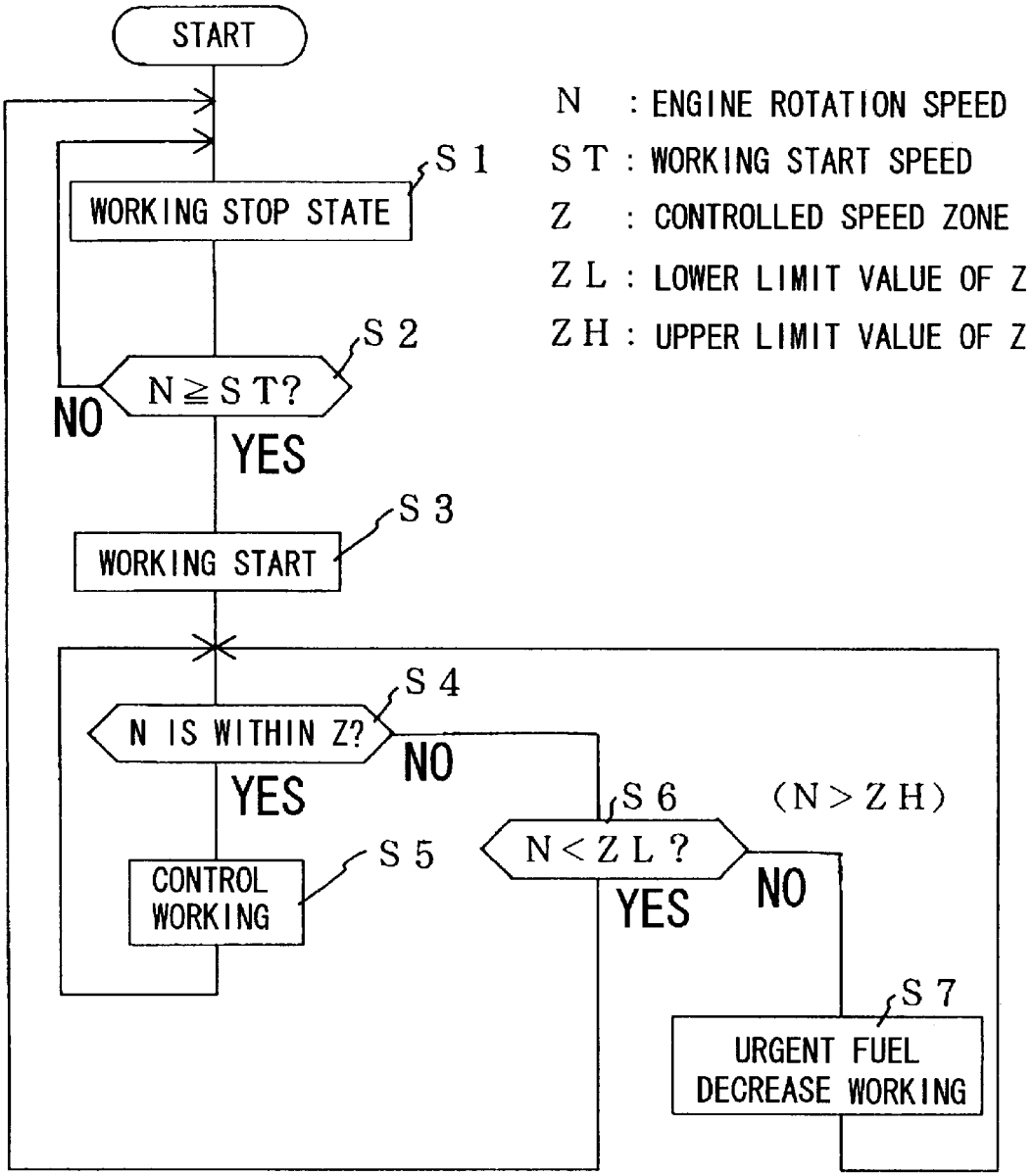
FIG. 1 is a flow chart outlining the processing of a controller in a first embodiment.

The electronic governor 1 corrects the fuel supply so as to decrease it in the case of non-cold starting rather than in the case of cold starting. For this purpose, as shown in FIG. 1, the electronic governor 1 is provided with a temperature sensor 37. The electronic governor 1 decreases the fuel supply in the engine starting area 7 in the case where the detected engine temperature exceeds a predetermined value when compared with the case where it is below the predetermined value. In other words, the electronic governor 1 holds the fuel metering portion 3 at a starting fuel increase limit position 7*a*. The engine temperature can be sensed through detecting the engine machine wall temperature, engine cooling water temperature and engine oil temperature. Besides, it can be judged also by sensing the temperature of the air around the engine whether or not the engine makes the cold starting. This can inhibit the production of black smoke and the wasteful consumption of fuel.

The electronic governor 1 is also provided with a means 38 for detecting boost of intake air and has such a boost compensating function that it can correct the fuel supply for limitation until the pressure of the oversupplied intake air sufficiently increases. Additionally, the electronic governor 1 is provided with an atmospheric pressure detecting means 39 and has such a highland compensating function that it can correct the fuel supply for decrease when the atmosphere has a low pressure. Besides, the electronic governor 1 has an operation speed detecting means 40 so that it can suppress the working speed of the output portion 9 to prohibit the overshooting of the fuel metering portion 3 if the speed setting means 18 operates too fast. The fuel supply can be corrected for limitation or decrease by reducing the steady state rotation speed (NX) of the electronic control. It is to be noted such a function can be also effected by a fuel limiter which receives the fuel metering portion to restrict the fuel increase.

The actuator is controlled for starting and stopping in the following manner.

While the engine is in operation, the controller 16 stops the actuator 17 from working until the engine rotation speed (N) increases to a working start speed (ST) and starts the actuator 17 working when the engine rotation speed (N) increases to the working start speed (ST). Further, it makes the actuator 17 continue to perform the control working while the engine rotation speed (N) is in a predetermined controlled speed zone (Z) and stops the actuator from working when the engine rotation speed (N) is reduced to a lower limit value (ZL) of the controlled speed zone (Z).

The actuator 17 is set for starting control and stopping control in the following manner.

Upon determination of the steady state rotation speed (NX) of the electronic control at the reference load, the controller 16 sets the working start speed (ST) and the controlled speed zone (Z). The working start speed (ST) is set to the same value as the steady state rotation speed (NX) of the electronic control at the reference load. The controlled speed zone (Z) is set over a range of ±100 rpm from the steady state rotation speed (NX) of the electronic control at the reference load. This controlled speed zone (Z) includes the working start speed (ST) and the steady state rotation speed (NX) of the electronic control at the loads equal to and below the reference load.

The speed setting means 18 changes the speed setting and the reference load changing means (M) varies the reference load to move the electronic control property line toward the high speed side or the low speed side in parallel. On shifting of the steady state rotation speed (NX) of the electronic control at the reference load, the controller 16 shifts the working start speed (ST) and the controlled speed zone (Z) by the same value. For instance, when the reference load changing means (M) is switched over from the mode (Ml) to the mode (M2), as shown in FIG. 4 the steady state rotation speed (NX) of the electronic control at the reference load shifts toward the high speed side by 5 rpm, but the controller 16 shifts the working start speed (ST) and the controlled speed zone (Z) toward the high speed side by the same value as that one.

Processing function of the controller 16 is outlined as follows.

As shown in FIG. 1, after the engine has started, the controller 16 stops the actuator 17 from working at Step S1. It judges at Step S2 whether or not the engine rotation speed (N) has increased to the working start speed (ST). If the judgement is 'NO', the controller 16 returns to Step S. When the judgement at Step S2 is 'YES', it starts the actuator 17 working at Step S3.

Further, it judges at Step S4 whether or not the engine rotation speed (N) is within the controlled speed zone (Z). If the judgement is 'YES', it makes the actuator 17 continue the control working at Step S5 and returns to Step S4. In the event the judgement at Step S4 is 'NO', it judges at Step S6 whether or not the engine rotation speed (N) has reduced to less than the lower limit value (ZL) of the controlled speed zone (Z). If the judgement is 'YES', the controller 16 returns to Step 1. Negative judgement at Step S6 means that the engine rotation speed (N) has increased to an upper limit value (ZH) of the controlled speed zone (Z). In this case, the controller 16 causes the actuator 17 to do an urgent fuel decrease working at Step S7 and returns to Step S4.

While the engine is in operation, the controller 16 processes as outlined below.

While the engine is in operation, the controller 16 continues to deny the judgement made at Step S2 and repeats the processing of Step S1 until the engine rotation speed (N) increases to the working start speed (ST) before the actuator 17 starts working at Step S3. Thus, during this term, the actuator 17 continues its working stop state and the mechanical control is performed. In the working stop state at Step S, the output portion 9 of the actuator 17 stands still at the working stop position 17*a* removed from the working range of the electronic input portion 11 of the fuel metering portion 3 toward the fuel increase side.

The controller 16 affirms the judgement made at Step S2 when the engine rotation speed (N) increases to the working start speed (ST), and it starts the actuator 17 working at Step S3. After the actuator 17 has started working, while the engine rotation speed (N) is in the controlled speed zone (Z), the controller 16 continues to affirm the judgement made at Step S4 and repeats the processing of Step 5, thereby causing the actuator 17 to continue its control working. When the engine rotation speed (N) has decreased to less than the lower limit value (ZL) of the controlled speed zone (Z), the controller 16 denies the judgement made at Step S4 and affirms the judgement made at Step S6 to return the actuator 17 to the working stop state of Step S1 prior to the commencement of the electronic control working. In this case, the fuel metering by the mechanical governor 2 is performed and thereafter the foregoing control is repeated.

If the engine rotation speed (N) exceeds the upper limit value (ZL) of the controlled speed zone (Z), the controller 16 denies the judgement made at Step S4 and subsequent judgement made at Step S6 to make the actuator 17 perform the urgent fuel decrease working at Step S7. The performed urgent fuel decrease working moves the output portion 9 of the actuator 17 in a direction for fuel decrease and the fuel metering portion 3 toward the fuel decrease side. During the urgent fuel decrease working, the controller 16 repeats the judgements made at Step S4 and Step S6 and temporarily interrupts the control working of the actuator 17 at Step S5 until the engine rotation speed (N) enters the controlled speed zone (Z). When the engine rotation speed (N) returns to the controlled speed zone (Z), the controller 16 affirms the judgement made at Step S4 and causes the actuator 17 to continue the control working at Step S5 interrupted before.

The detailed processing of the controller 16 is as follows.

Processing at the time of engine start.

Figure 9:
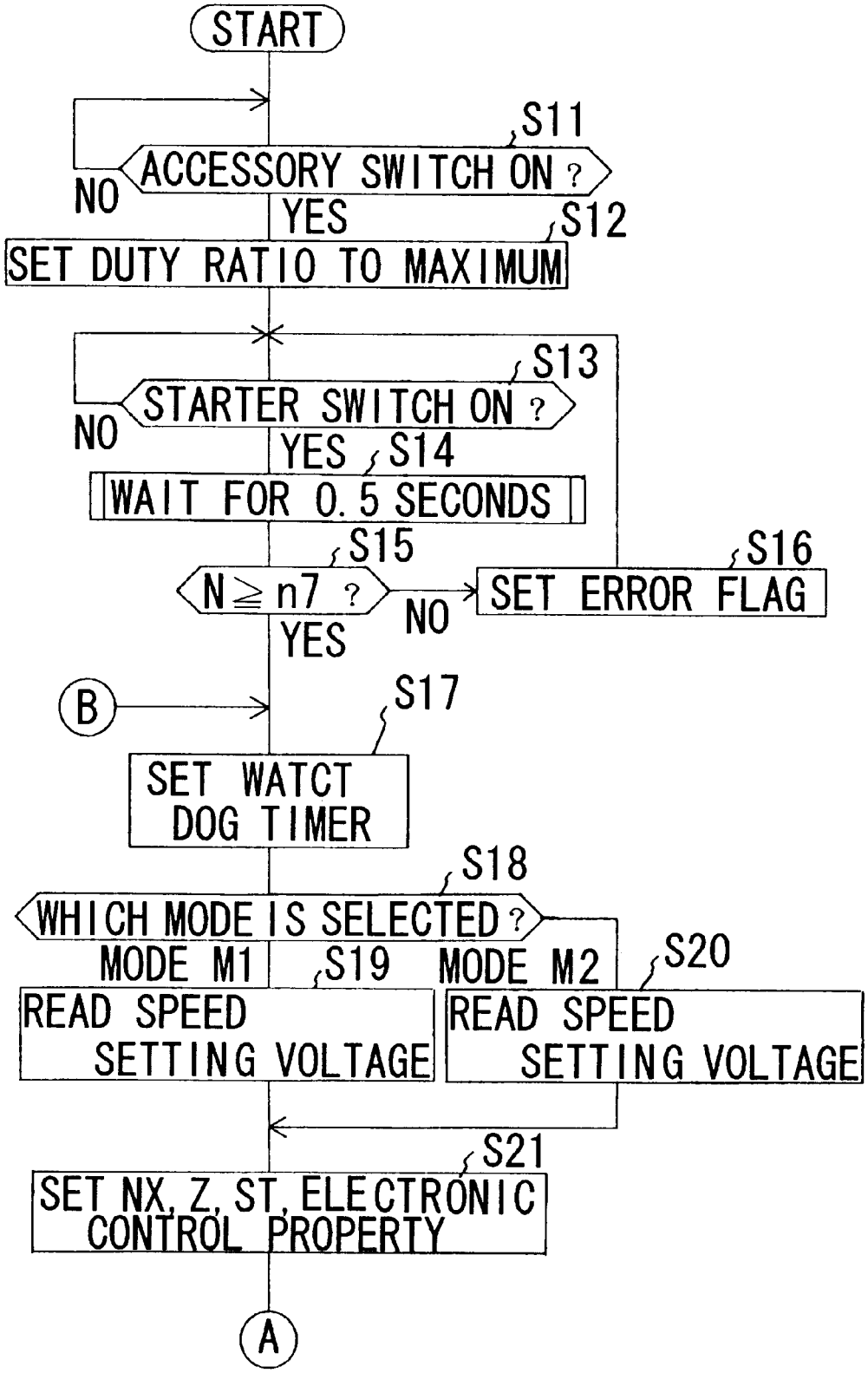
FIG. 9 is a front half portion of a flow chart showing in detail the processing of a controller of the first embodiment.

As shown in FIG. 9, at the time of engine start, the controller 16 judges at Step S11 whether or not an accessory switch is 'ON'. If the judgement is 'YES', it sets the duty ratio of the PWM wave to maximum so as to energize the actuator 17 of the electronic governor 1 in a maximum amount. In this case, the actuator 17 has the output portion 9 greatly pulled toward the fuel increase side to stand still at the working stop position 17*a* removed from the working range of the electronic input portion 11 of the fuel metering portion 3 toward the fuel increase side and comes to the working stop state.

Processing to confirm the engine start.

The controller 16 judges at Step S13 whether or not a starter switch is 'ON'. If the judgement is 'YES', it waits for 0.5 seconds at Step S14. Then it judges at Step S15 whether or not the engine rotation speed (N) has reached an idling rotation speed (n7) to ascertain the engine start. Conversely, when the judgement is 'NO', it sets an error flag at Step S16 and then returns to Step S13. The controller 16 interrupts sequential control processing at a predetermined cycle to detect whether or not the error flag is set. Provided that the error flag is set continuously a plurality of times, it performs an error processing. This error processing is conducted by setting the duty ratio of the PWM wave to maximum and maintaining the actuator 17 in the working stop state. In addition, it simultaneously alarms abnormality.

The error processing is conducted similarly not only in the case of erroneous engine start but also in such cases as, for example, detection of abnormal control by a watch dog timer to be mentioned later; breakage of the speed detecting means 15 and the set speed detecting means 18*c*; short; appearance of the voltage detected outside the optimum range; and so on.

Even in the event other various abnormalities are detected, the same error processing as mentioned above is effected.

Processing to set the electronic control property

If the controller 16 judges 'YES' at Step S15, it sets the watch dog timer at Step S17 and judges at Step S18 which of the modes (Ml) and (M2) the reference load changing means (M) has selected. At Step S19 or Step S20, it reads the speed setting voltage sent from the set speed detecting means 18*c*. Then the controller 16 sets the electronic control property at Step S21 based on the speed setting voltage and the mode selected by the reference load changing means (M).

The controller 16 processes at Step S22 and subsequent Steps as follows.

Figure 10:
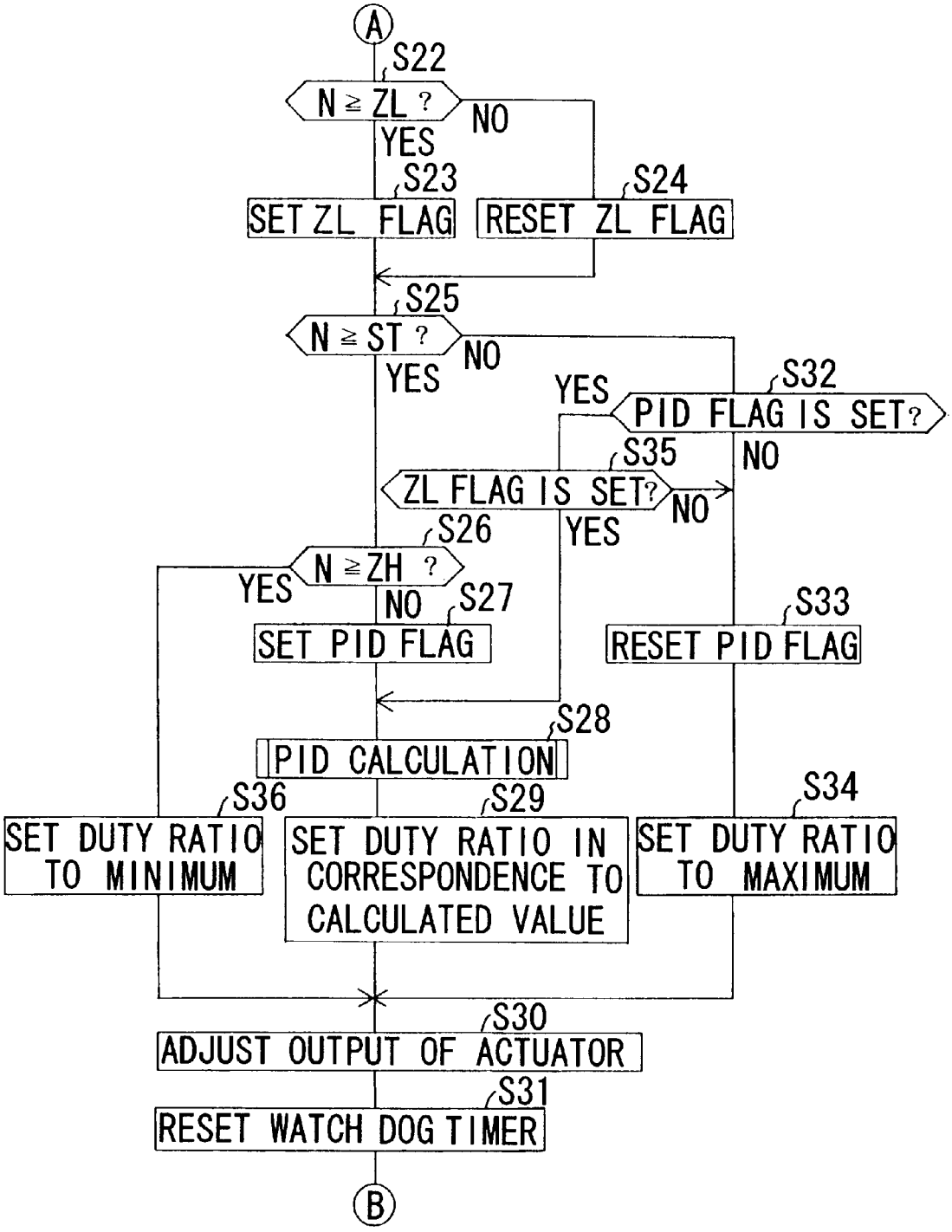
FIG. 10 is a rear half portion of the flow chart showing in detail the processing of the controller of the first embodiment.

As shown in FIG. 10, the controller 16 judges at Step S22 whether or not the engine rotation speed (N) is not less than the lower limit value (ZL) of the controlled speed zone (Z). And it sets a ZL flag at Step S23 and resets the ZL flag at Step S24. Then it judges at Step S25 whether or not the engine rotation speed (N) is not less than the working start speed (ST) and judges at Step S26 whether or not the engine rotation speed (N) is not less than the upper limit value (ZH) of the controlled speed zone (Z).

The controller 16 sets a PID flag at Step S27 and carries out a PID calculation at Step S28. It sets the duty ratio of the PWM wave in correspondence to a value resulting from the PID calculation at Step 29, adjusts the output of the actuator 17 at Step S30 and resets the watch dog timer at Step S31. After Step S31, it returns to Step S17. Further, the controller 16 judges at Step S32 whether or not the PID flag is set. It resets the PID flag at Step S33 and sets the duty ratio of the PWM wave to maximum at Step S34. At Step S35 it judges whether or not the ZL flag is set. Additionally, it sets the duty ratio of the PWM wave to minimum at Step S36. At Step S28 the PID calculation is carried out without totalizing the data gained before the actuator 17 starts working. The PID control may be replaced by PI control.

While the engine is in operation, the detailed processing of the controller 16 is as follows.

The following processing continues the working stop state of Step S1.

Before the actuator 17 starts working at Step S3, the controller 16 repeats the processing of Step S1 until the engine rotation speed (N) increases up to the working start speed (ST), thereby continuing the working stop state of the actuator 17 at Step S1. In this case, the controller 16 repeats sequential processing of: denying the judgement made at Step S22; conducting the processing of Step S24; denying the judgement made at Step S25; denying the judgement made at Step S32; conducting the processing of Step S33; keeping the duty ratio of the PWM wave maximum at Step S34; and maintaining the output of the actuator 17 maximum at Step S30.

Working starts at Step S3 by the following processing.

At Step S3 the actuator 17 starts working in the case where the engine rotation speed (N) has increased to the working start speed (ST). In this case, the controller 16 conducts sequential processing of: affirming the judgement made at Step S22, conducting the processing of Step S23; affirming the judgement made at Step S25; denying the judgement made at Step S26; conducting the processing of Step S27; calculating a deviation between the steady state rotation speed (NX) and the engine rotation speed (N) at Step S28; setting the duty ratio of the PWM wave in correspondence to the calculated deviation value at Step S29; and adjusting the output of the actuator 17 at Step S30.

The control working of Step S5 continues by the following processing.

While the engine rotation speed (N) is within the controlled speed zone (Z), the controller 16 repeats the processing of Step S5, thereby continuing the control working of the actuator 17 at Step S5. In the event the engine rotation speed (N) is not less than the working start speed (ST), the controller 16 repeats the same sequential processing as in the case of working start. If the engine rotation speed (N) is less than the working start speed (ST), the controller 16 repeats sequential processing of: affirming the judgement made at Step S22; conducting the processing of Step S23; denying the judgement made at Step S25; affirming the judgement made at Step S32; affirming the judgement made at Step S35; and conducting the sequential processing of Step 28, Step 29 and Step S30.

The controller 16 returns to Step S1 by the following processing.

It returns to the working stop state of the actuator 17 at Step S1 when the engine rotation speed (N) has reduced to less than the lower limit value (ZL) of the controlled speed zone (Z). In this case, the controller 16 does the processing of: denying the judgement made at Step S22; conducting the processing of Step S24; denying the judgement made at Step S25; denying the judgement made at Step S32; conducting the processing of Step S33; setting the duty ratio of the PWM wave to maximum at Step S34; and adjusting the output of the actuator 17 to maximum at Step S30.

The following processing carries out the urgent fuel decrease working at Step S7.

The urgent fuel decrease working of the actuator 17 at Step S7 is effected in the case where the engine rotation speed (N) has exceeded the upper limit value (ZH) of the controlled speed zone (Z). In this case, the controller 16 repeats the processing of: affirming the judgement made at Step S22; conducting the processing of Step S23; affirming both of the judgements made at Step S25 and Step S26; setting the duty ratio of the PWM wave to minimum at Step S36; and adjusting the output of the actuator 17 to minimum at Step S30.

Figure 11:
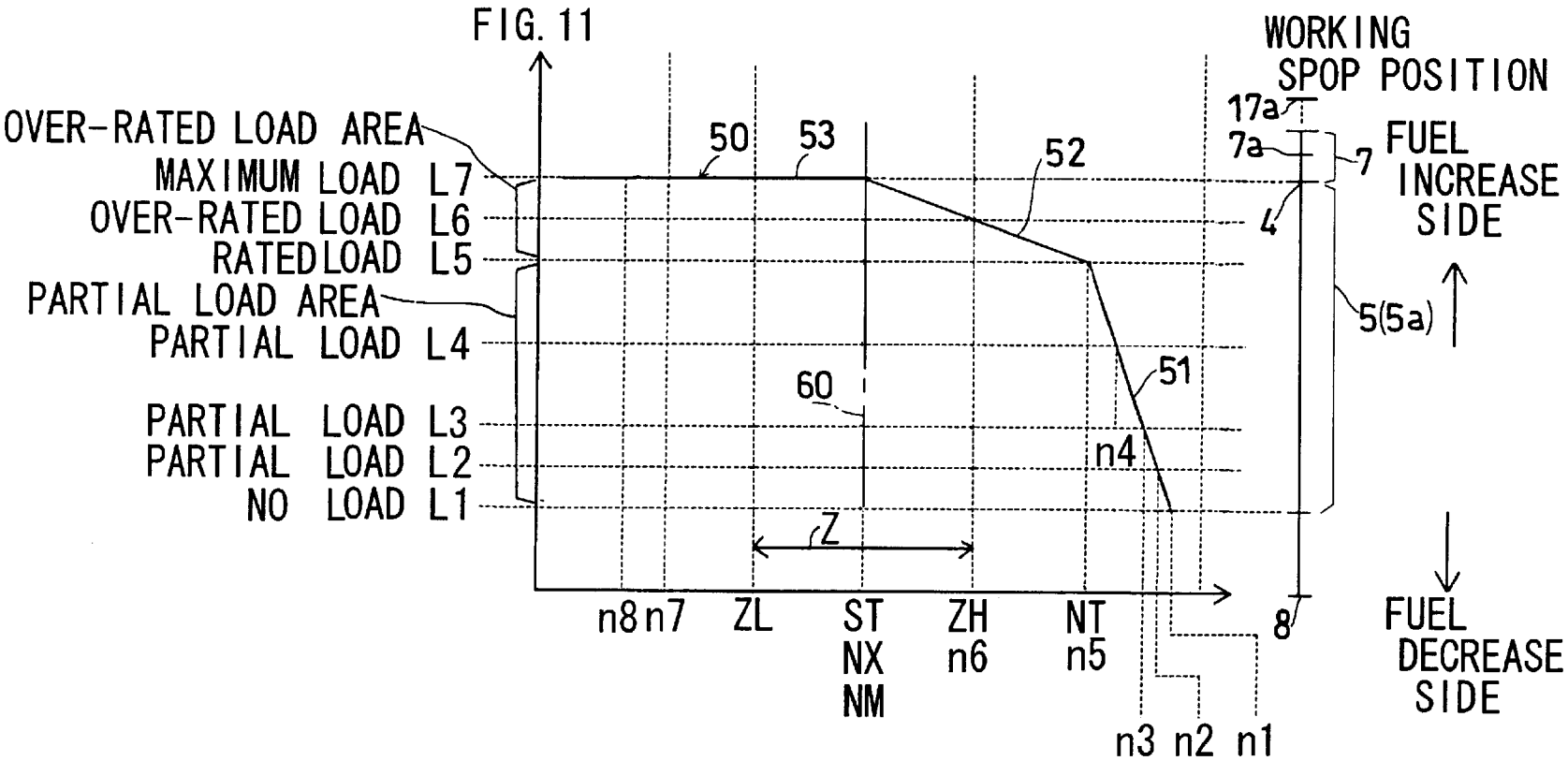
FIG. 11 graphically shows control properties of a first modification of the first embodiment set at a high speed and in the mode (M1)
Figure 12:
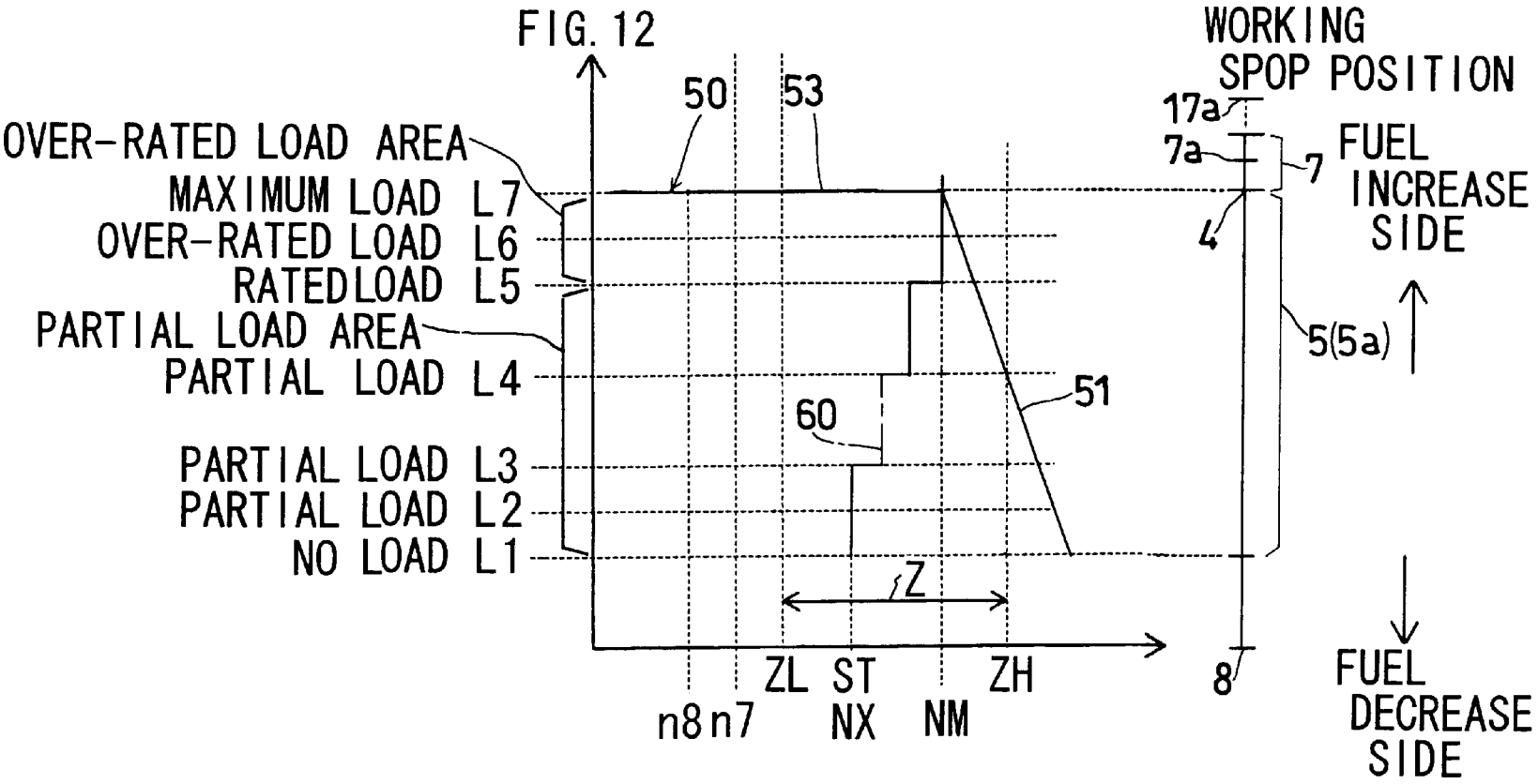
FIG. 12 graphically shows control properties of a second modification of the first embodiment set at a low speed and in the mode (M1)

FIG. 11 shows a first modification of the first embodiment. In this first modification, when the speed setting means 18 shown in FIG. 2 sets a high speed and the reference load changing means (M) selects the mode (Ml), the electronic speed control one-dot-chain line 60 in FIG. 11 crosses an upper limit of the torque-up line 52 at a maximum load (L7). In this case, the device takes the electro-solo control mode. FIG. 12 shows a second modification of the first embodiment. In this second modification, when the speed setting means 18 shown in FIG. 2 sets a low speed and the reference load changing means (M) selects the mode (M1), as shown in FIG. 12, on condition that the steady state rotation speed (NX) of the electronic control at the loads (L1) to (L6) is lower than a maximum torque rotation speed (NM), the controller 16 alters the isochronous control property to the droop control property and approaches the steady sate rotation speed (NX) of the electronic control to the maximum torque rotation speed (NM) as the load increases.

The droop control property requires to detect the load because the steady state rotation speed (NX) of the electronic control differs in correspondence to the load. None of the above embodiments includes a metering position detecting means which directly detects the metering position of the fuel metering portion 3. Therefore, the load cannot be detected by such means. However, it is possible to detect the load by other means. For instance, the metering position of the fuel metering portion 3 and eventually the load can be indirectly detected through sensing an electric current value of an actuator driving circuit when the engine rotation speed (N) has been settled on the steady state rotation speed (NX) of the electronic control. Further, the load may be detected through detecting a distortion caused by a twist of the crank shaft with a torque sensor. However, in the event priority is put on cost reduction, the engine does not employ any or a part of the above-mentioned sensor, the temperature sensor 37, the boost sensor 38, the atmospheric pressure sensor 39 and the operation speed detecting means 40.

Figure 13:
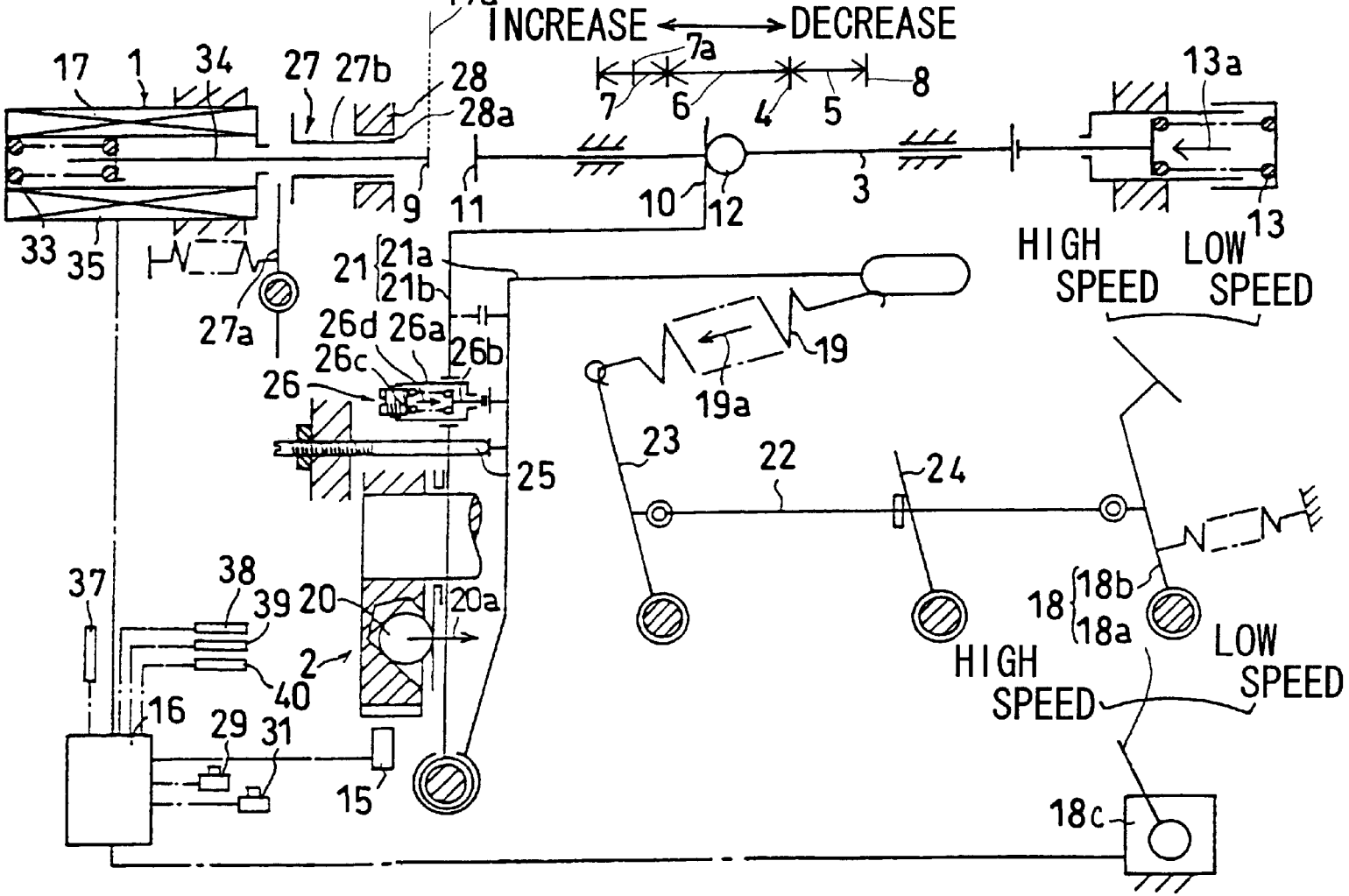
FIG. 13 is a schematic view illustrating an electronic governor and a mechanical governor of a second embodiment.
Figure 14:
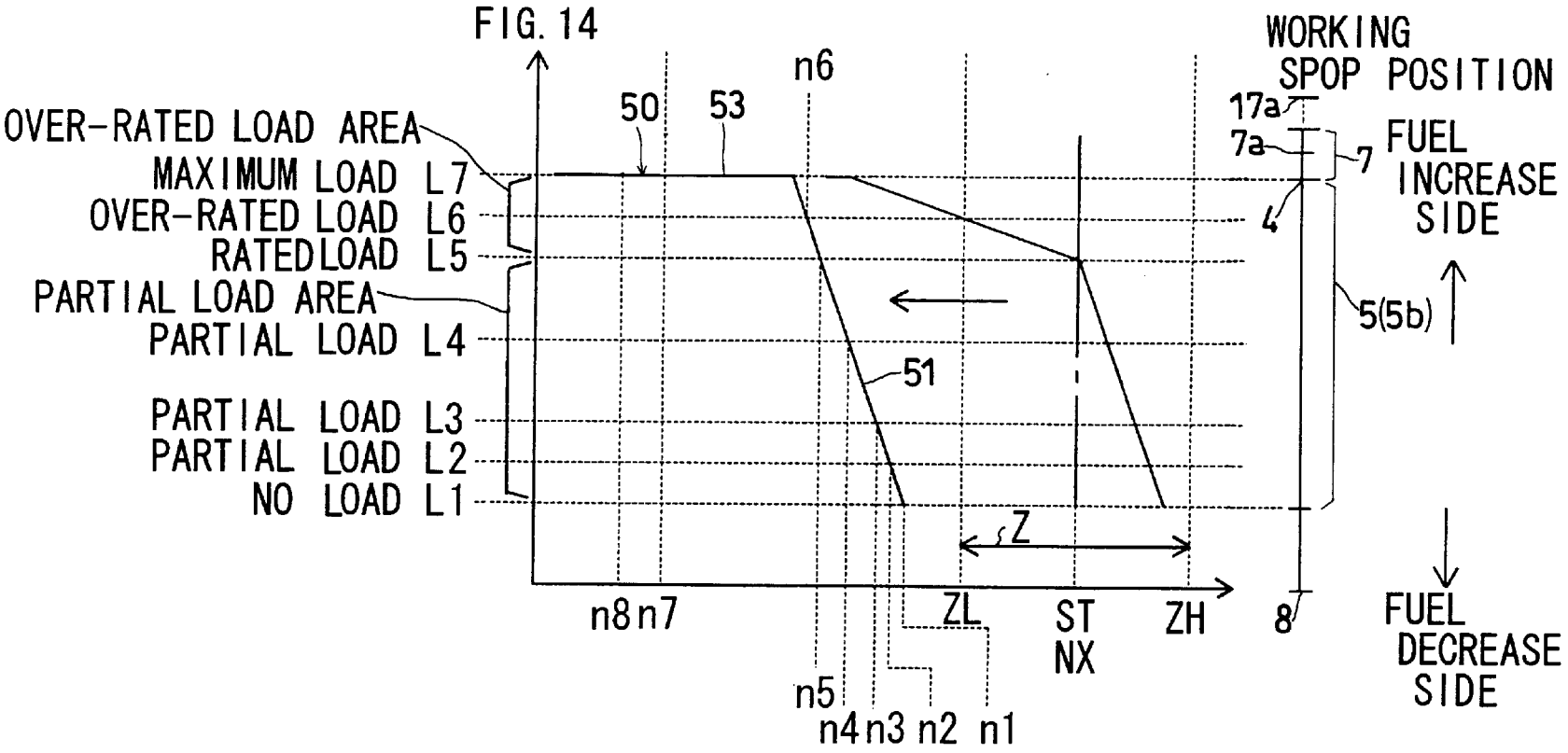
FIG. 14 graphically shows control properties at the time of a mecha-solo control of the second embodiment.
Figure 15:
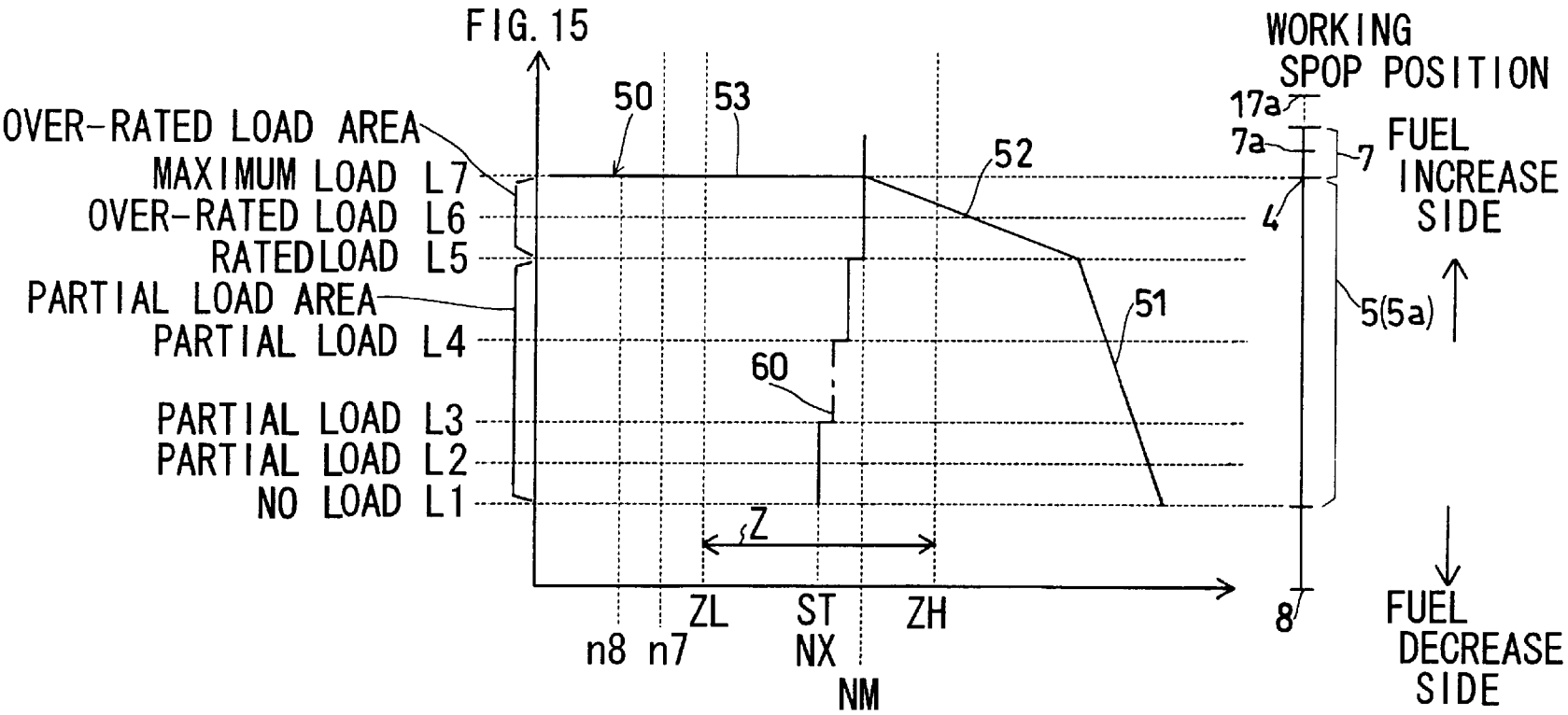
FIG. 15 graphically shows control properties at the time of a droop control of the second embodiment.

FIGS. 13 to 15 explain a fuel supplying device according to a second embodiment.

This second embodiment is distinct from the first embodiment on the following points.

The speed setting means 18 shown in FIG. 13 comprises a speed setting means **18*a* for the electronic governor 1 and a speed setting means 18*b* for the mechanical governor 2. These speed setting means 18*a* and 18*b*** set speeds to set the electronic control property and the mechanical control property independently, thereby making it possible to set the level of the reference load freely.

Employed for the speed setting means **18*b* of the mechanical governor 2 is a pedal, which is interlockingly connected to the connecting rod 22. An engaging lever 24 is provided near the connecting rod 22. After having moved the speed setting means 18*b* to an optional setting position, the lever 24 engages with the connecting rod 22, thereby preventing the return of the speed setting means 18*b* to the low speed side from the optional setting position. The other construction and function are the same as those of the first embodiment. In FIGS. 13 to 15**, the same elements as those in the first embodiment are designated by the same characters.

The electronic control property and the mechanical control property are set in the following manner and behavior.

In the event that the respective speed setting means 18*a* and 18*b* set high speeds, the same composite control property as shown in FIG. 3 can be obtained, thereby making it possible to perform a high speed operation in which the rated load (L5) is set as the reference load. If only the speed setting means 18*a* for the electronic governor 1 slightly shifts from this state toward the high speed side, the same composite control property as shown in FIG. 4 can be attained, thereby making it possible to perform a high speed operation in which the partial load (L3) is set as the reference load.

In the event the respective speed setting means 18*a* and 18*b* set low speeds, the same composite control property as shown in FIG. 5 can be gained, thereby making it possible to perform a low speed operation in which the rated load (L5) is set as the reference load. If only the speed setting means 18*a* for the electronic governor 1 slightly shifts from this state toward the high speed side, the same control property as shown in FIG. 6 is obtained, thereby making it possible to perform a low speed operation in which the partial load (L3) is set as the reference load. The speed settings of the respective speed setting means 18*a* and 18*b* are combined with each other in various ways to thereby attain various sorts of control properties different in speed setting and reference load.

When the speed setting means 18*a* for the electronic governor 1 sets a high speed and the speed setting means 18*b* for the mechanical governor 2 sets a low speed, as shown in FIG. 14, the steady state rotation speeds (n1) to (n6) of the mechanical control at the loads (L1) to (L6) each comes to a value less than the control working start speed (ST) of the electronic governor 1. Therefore, the electronic control is not performed, thereby enabling the composite control of the electronic control and the mechanical control or the electro-solo control to switch over to the mecha-solo control.

When the speed setting means 18*a* for the electronic governor 1 and the speed setting means 18*b* for the mechanical governor 2 set a low speed and a high speed, respectively, and the steady state rotation speed (NX) of the electronic control at the loads (L1) to (L6) becomes lower than the maximum torque rotation speed (NM) as shown in FIG. 15, the controller 16 alters the isochronous control property to the droop control property and approaches the steady state rotation speed (NX) of the electronic control to the maximum torque rotation speed (NM) as the load increases.

Figure 16:
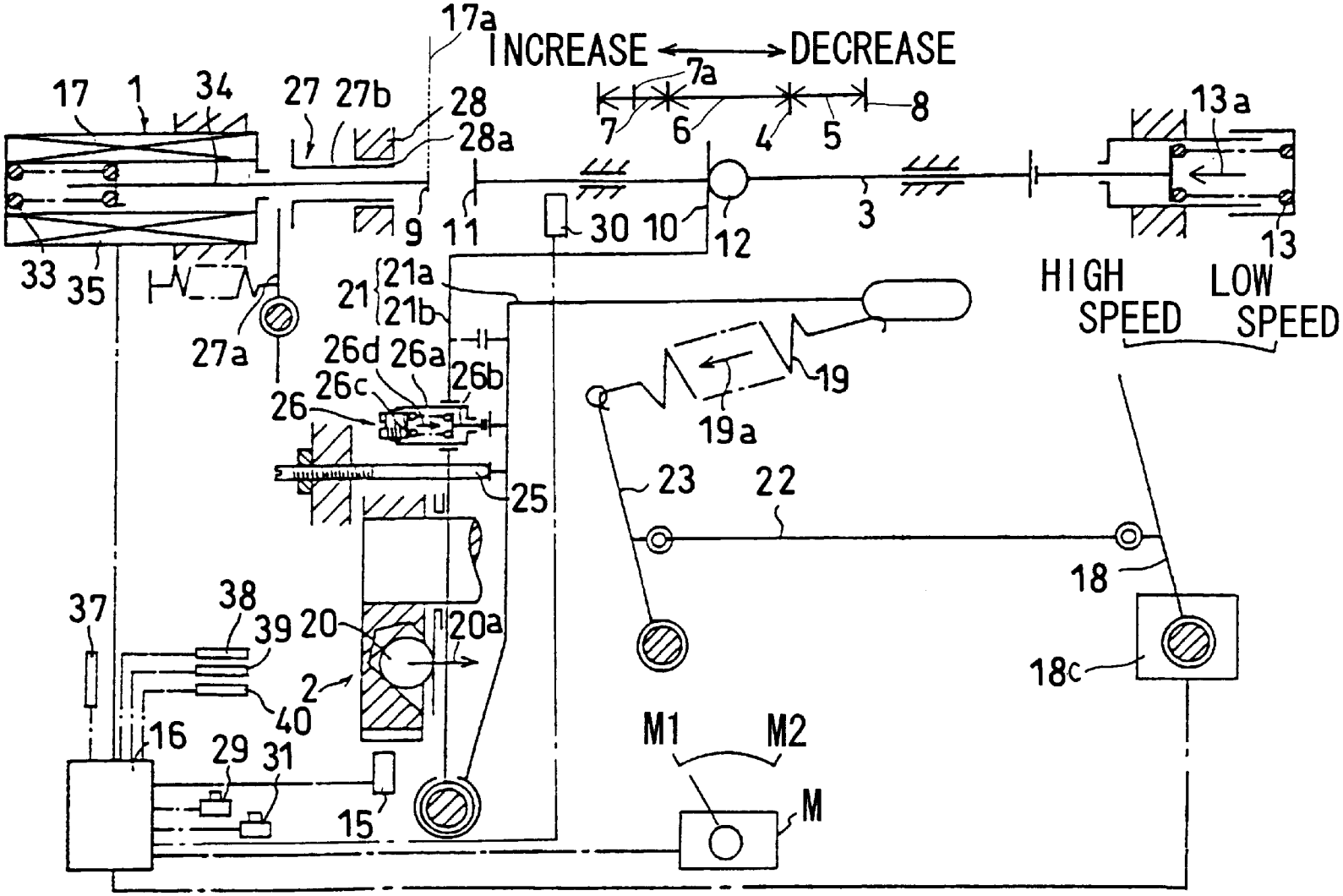
FIG. 16 schematically shows an electronic governor and a mechanical governor of a third embodiment.
Figure 17:
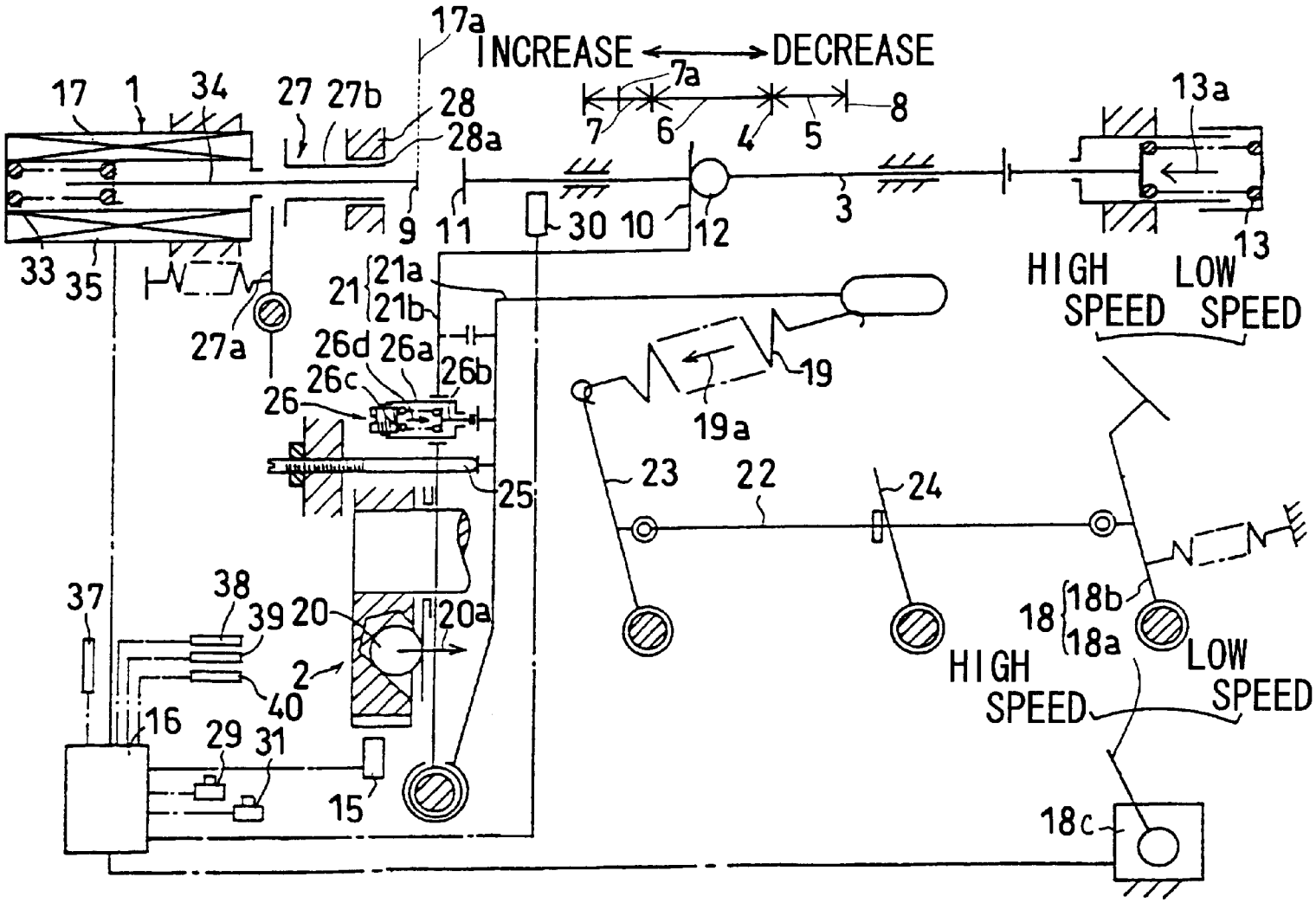
FIG. 17 schematically shows an electronic governor and a mechanical governor of a fourth embodiment.

FIG. 16 explains a third embodiment of the present invention. This third embodiment differs from the first embodiment in that it includes a metering position detecting means 30 for the fuel metering portion 3. FIG. 17 explains a fourth embodiment of the present invention. This fourth embodiment is distinct from the second embodiment in that it includes a metering position detecting means 30 for the fuel metering portion 3. Each of these third and fourth embodiments has the metering position detecting means 30 for the fuel metering portion 3, so that generally the electronic governor 1 produces a faster steady state speed. Therefore, in these embodiments, the electronic governor 1 may be adjusted so as to always work without setting the working start speed (ST) and the controlled speed zone (Z).

What is claimed is:

1. A fuel supplying device for an engine comprising an electronic governor (1) and a mechanical governor (2), wherein the mechanical governor (2) limits a maximum fuel injection amount of an electronic control by the electronic governor (1).

2. The fuel supplying device as set forth in claim 1, wherein a maximum fuel injection position (4) of a fuel metering portion (3) in the electronic control comes to a halfway position of a speed control area (5) of the fuel metering portion (3), the device automatically switching over the electronic control by the electronic governor (1) to a mechanical control by the mechanical governor (2) and vice versa at the maximum fuel injection position (4) and performing the electronic control in a fuel decrease side area (5*a*) of the speed control area (5) with respect to the maximum fuel injection position (4) and doing the mechanical control in a fuel increase side area (5*b*) with respect to the maximum fuel injection position (4).

3. The fuel supplying device as set forth in claim 2 changing a composite control mode which performs the electronic control and the mechanical control in the speed control area (5) of the fuel metering portion (3), over to an electro-solo control mode which performs only the electronic control over the whole area (5*a*) of the speed control area (5).

4. The fuel supplying device as set forth in claim 2 changing a composite control mode which performs the electronic control and the mechanical control in the speed control area (5) of the fuel metering portion (3), over to a mecha-solo control mode which performs only the mechanical control over the whole area (5*b*) of the speed control area (5).

5. The fuel supplying device as set forth in claim 1, wherein the electronic governor (1) includes an electronic output portion (9) and the mechanical governor (2) includes a mechanical output portion (10), the fuel metering portion (3) being provided with an electronic input portion (11) and a mechanical input portion (12), the electronic output portion (9) facing the electronic input portion (11) from a fuel increase side, the mechanical output portion (10) opposing the mechanical input portion (12) from the fuel increase side, an urging means (13) urging the fuel metering portion (3) to the fuel increase side, in an area (5*a*) where the electronic control is performed, the electronic input portion (11) being brought into contact with the electronic output portion (9), thereby connecting the former to the latter and retaining the mechanical input portion (12) separated from the mechanical output portion (10), in an area (5*b*) where the mechanical control is performed, the mechanical input portion (12) being brought into contact with the mechanical output portion (10), thereby connecting the former to the latter and retaining the electronic input portion (11) separated from the electronic output portion (9).

6. The fuel supplying device as set forth in claim 1, wherein the electronic governor (1) effects fuel metering in an engine starting area (7).

7. The fuel supplying device as set forth in claim 6, wherein the electronic governor (1) is provided with a temperature sensing means (37) which senses a temperature of an engine and a temperature of the air around the engine, fuel supply in the engine starting area (7) being adjusted to become smaller in the case where at least one of the sensed temperatures exceeds a predetermined value than in the case where it is below the predetermined value.

8. The fuel supplying device as set forth in claim 1, wherein the electronic governor (1) moves the fuel metering portion (3) to a fuel supply stop position (8).

9. The fuel supplying device as set forth in claim 1, wherein the electronic governor (1) is provided with an actuator (17), which has an electronic output portion (9) urged by a spring (33), when the actuator (17) is cancelled from being energized, the electronic output portion (9) being adjusted to move the fuel metering portion (3) to a fuel supply stop position (8) through an urging force of the spring (33).

10. The fuel supplying device as set forth in claim 1, wherein a speed setting means (18) sets a speed to set an electronic control property by the electronic governor (1) and a mechanical control property by the mechanical governor (2) so that at a predetermined reference load (L5) a fuel metering portion (3) comes to a maximum fuel injection position (4) of the electronic control and a steady state rotation speed (NX) of the electronic control at loads (L4) to (L1) below the predetermined reference load (L5) becomes lower than steady state rotation speeds (n4) to (n1) of the mechanical control at the same loads (L4) to (L1), the electronic governor (1) settling an engine rotation speed (N) on the steady state rotation speed (NX) of the electronic control at the loads (L4–L1) below the reference load (L5).

11. The fuel supplying device as set forth in claim 10, wherein the steady state rotation speed (NX) of the electronic control takes the same value at the respective loads (L4) to (L1) below the reference load (L5).

12. The fuel supplying device as set forth in claim 10, wherein a single speed setting means (18) changes a speed to vary control properties so that an electronic control property line (60) and a mechanical control property line (51) designating the electronic control property and the mechanical control property, respectively shift in series in a direction for increasing or decreasing an engine rotation speed.

13. The fuel supplying device as set forth in claim 12, wherein a reference load changing means (M) changes the reference load (L5) to another reference load (L3) different therefrom in level.

14. The fuel supplying device as set forth in claim 10, wherein the speed setting means (18) comprises a speed setting means (18*a*) for the electronic governor (1) and a speed setting means (18*b*) for the mechanical governor (2), the speed setting means (18*a*) and (18*b*) setting speeds to set the electronic control property and the mechanical control property independently so as to set the level of the reference load freely.

15. The fuel supplying device as set forth in claim 10, wherein when the speed setting means (18) sets a speed to settle the steady state rotation speed (NX) of the electronic control at the reference load (L3) on a value exceeding a rated rotation speed (NT) of the engine, the electronic governor (1) changes the reference load (L3) to a new higher load (L5), and while the engine is in operation, at loads (L5) to (L1) equal to or below the new reference load (L5), the electronic governor (1) settles an engine rotation speed (N) on a steady state rotation speed (NX') of the electronic control not higher than the rated rotation speed (NT) and at load (L6) exceeding the new reference load (L5), the mechanical governor (2) limits the engine rotation speed (N) to not higher than the rated rotation speed (NT).

16. The fuel supplying device as set forth in claim 10, wherein at the loads (L4) to (L1) below the reference load (L5), the electronic governor (1) settles the engine rotation speed (N) on the steady state rotation speed (NX) of the electronic control, and the electronic governor (1) sets a working start speed (ST), while the engine is in operation, before the electronic governor (1) starts working, the electronic governor (1) keeping a working stop state until the engine rotation speed (N) increases up to the working start speed (ST), thereby enabling the mechanical governor (2) to effect a fuel metering.

17. The fuel supplying device as set forth in claim 16, wherein the electronic governor (1) sets a controlled speed zone (Z) including the steady state rotation speed (NX) of the electronic control at the loads (L5) to (L1) equal to or below the reference load (L5) and the working start speed (ST), and while the engine is in operation, the electronic governor (1) starts working when the engine rotation speed (N) increases up to the working start speed (ST) of the electronic governor (1), after the electronic governor (1) has started working, while the engine rotation speed (N) is within the controlled speed zone (Z), the electronic governor continuing a control working and when the engine rotation speed (N) has reduced to less than a lower limit value (ZL) of the controlled speed zone (Z), the electronic governor (1) returning to the working stop state prior to the commencement of its working, thereby enabling the mechanical governor (2) to effect the fuel metering.

18. The fuel supplying device as set forth in claim 17, wherein while the engine is in operation, when the engine otation speed (N) exceeds an upper limit value (ZH) of he controlled speed zone (Z), the electronic governor (1) performs an urgent fuel decrease working to thereby interrupt the control working to move the fuel metering portion (3) toward a fuel decrease side so as to return the engine rotation speed (N) to the controlled speed zone (Z), and when the engine rotation speed (N) reenters the controlled speed zone (Z), the electronic governor (1) continues the control working interrupted before.

19. The fuel supplying device as set forth in claim 10, wherein the used electronic governor (1) does not include a metering position detecting means for the fuel metering portion (3).

20. The fuel supplying device as set forth in claim 10, wherein the electronic governor (1) performs a control working by PID control or PI control and carries out arithmetic processing without totalizing the data obtained before it starts working.

21. The fuel supplying device as set forth in claim 10 wherein while the electronic governor (1) is in control working, when an output portion (9) of the electronic governor (1) advances too much in a direction for fuel increase, the fuel metering portion (3) has a mechanical input portion (12) received by an output portion (10) of the mechanical governor (2) and the electronic governor (1) has the output portion (9) separated from an electronic input portion (11) of the fuel metering portion (3).

22. The fuel supplying device as set forth in claim 1, wherein in a speed control area (5) where the electronic control is performed, when an engine rotation speed is lower than a maximum torque rotation speed (NM), as the engine load increases, the engine rotation speed is controlled so as to approach the maximum torque rotation speed (NM).

* * * * *